US007081817B2

(12) United States Patent
Zhevelev et al.

(10) Patent No.: US 7,081,817 B2
(45) Date of Patent: Jul. 25, 2006

(54) MOTION DETECTION APPARATUS EMPLOYING MILLIMETER WAVE DETECTOR

(75) Inventors: Boris Zhevelev, Rishon le Zion (IL); Mark Moldavsky, Petach Tikva (IL); Michael Lahat, Kiryat Ono (IL); Yaacov Kotlicki, Ramat Gan (IL)

(73) Assignee: Visonic Ltd., Tel Aviv (IL)

( * ) Notice: Subject to any disclaimer, the term of this patent is extended or adjusted under 35 U.S.C. 154(b) by 0 days.

(21) Appl. No.: 10/474,139

(22) PCT Filed: Apr. 1, 2002

(86) PCT No.: PCT/IL02/00272

§ 371 (c)(1),
(2), (4) Date: Mar. 8, 2004

(87) PCT Pub. No.: WO02/082004

PCT Pub. Date: Oct. 17, 2002

(65) Prior Publication Data

US 2004/0135688 A1 Jul. 15, 2004

Related U.S. Application Data

(60) Provisional application No. 60/281,209, filed on Apr. 3, 2001.

(51) Int. Cl.
*G08B 13/18* (2006.01)

(52) U.S. Cl. ..... 340/567; 340/541; 340/565; 340/545.3; 250/336.1; 250/339.14

(58) Field of Classification Search ..... 340/567, 340/541, 565, 552, 555, 500, 545.3; 250/336.1, 250/338.1, DIG. 1, 342, 339.14, 339.05, 250/339.15

See application file for complete search history.

(56) References Cited

U.S. PATENT DOCUMENTS

| | | | | |
|---|---|---|---|---|
| 4,510,622 | A | 4/1985 | Mori et al. | |
| 4,516,115 | A * | 5/1985 | Frigon et al. | 340/556 |
| 4,896,039 | A * | 1/1990 | Fraden | 250/342 |
| 4,971,409 | A | 11/1990 | Yeh et al. | |
| 5,182,564 | A | 1/1993 | Burkett et al. | |
| 5,202,692 | A * | 4/1993 | Huguenin et al. | 342/179 |
| 5,461,231 | A * | 10/1995 | Sugimoto et al. | 250/342 |
| 5,530,247 | A * | 6/1996 | McIver et al. | 250/336.1 |
| 5,555,036 | A | 9/1996 | Harnett et al. | |
| 5,693,943 | A * | 12/1997 | Tchernihovski et al. | 250/342 |

(Continued)

OTHER PUBLICATIONS

Robert L. Rogers, et al., "Development and Tests of Low Cost Passive Millimeter Wave Sensor," Technical Report; ARL, The University of Texas at Austin, Apr. 15, 1997.

*Primary Examiner*—Daniel Wu

*Assistant Examiner*—Daniel Previl

(74) *Attorney, Agent, or Firm*—Townsend and Townsend and Crew LLP

(57) ABSTRACT

A system and method for motion detection, useful, for example, in intrusion detection, access control, and energy management, including an incoherent detector, including at least one sensing element, operative to detect receipt of radiation having a wavelength between 0.05 mm and 10 mm from multiple fields of view, and a motion detector receiving an output of the incoherent detector and providing a motion detection output indicating receipt of radiation from an object moving between the multiple fields of view.

104 Claims, 25 Drawing Sheets

U.S. PATENT DOCUMENTS 5,790,025 A 8/1998 Amer et al.
5,815,113 A 9/1998 Lo et al.
5,980,123 A * 11/1999 Heifler ..... 396/427
6,163,257 A * 12/2000 Tracy ..... 340/506
6,250,601 B1 6/2001 Kolar et al.
6,384,414 B1 * 5/2002 Fisher et al. ..... 250/339.14

* cited by examiner

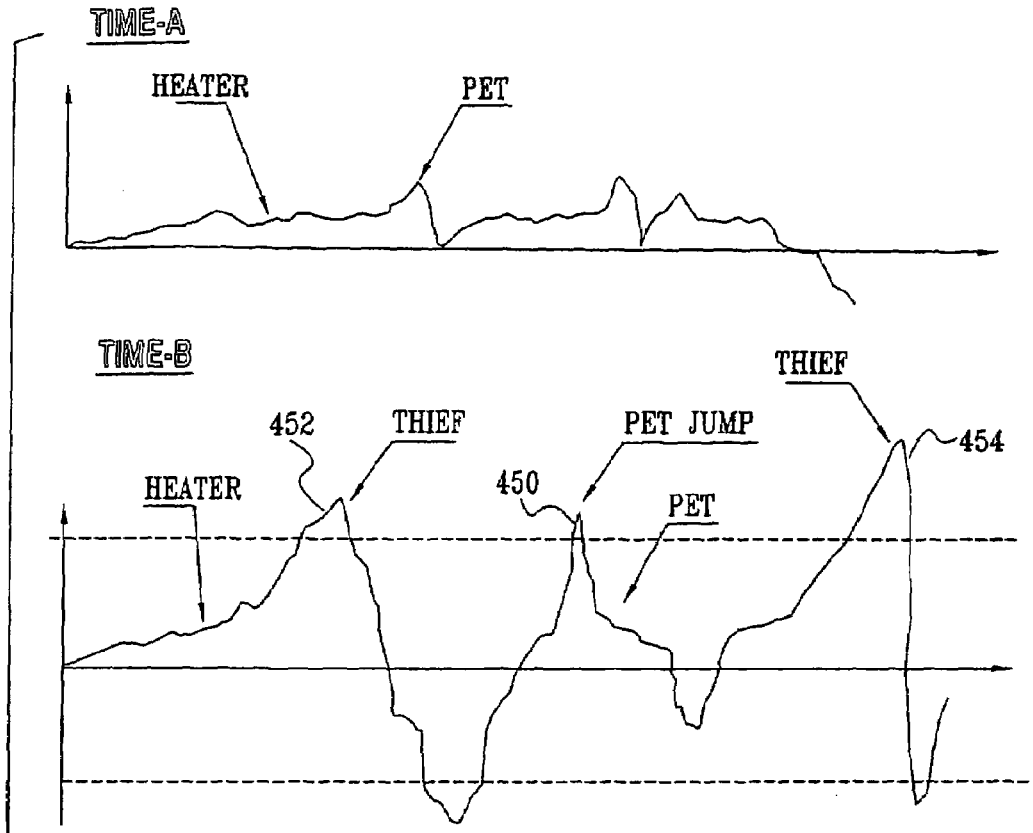
FIG. 4
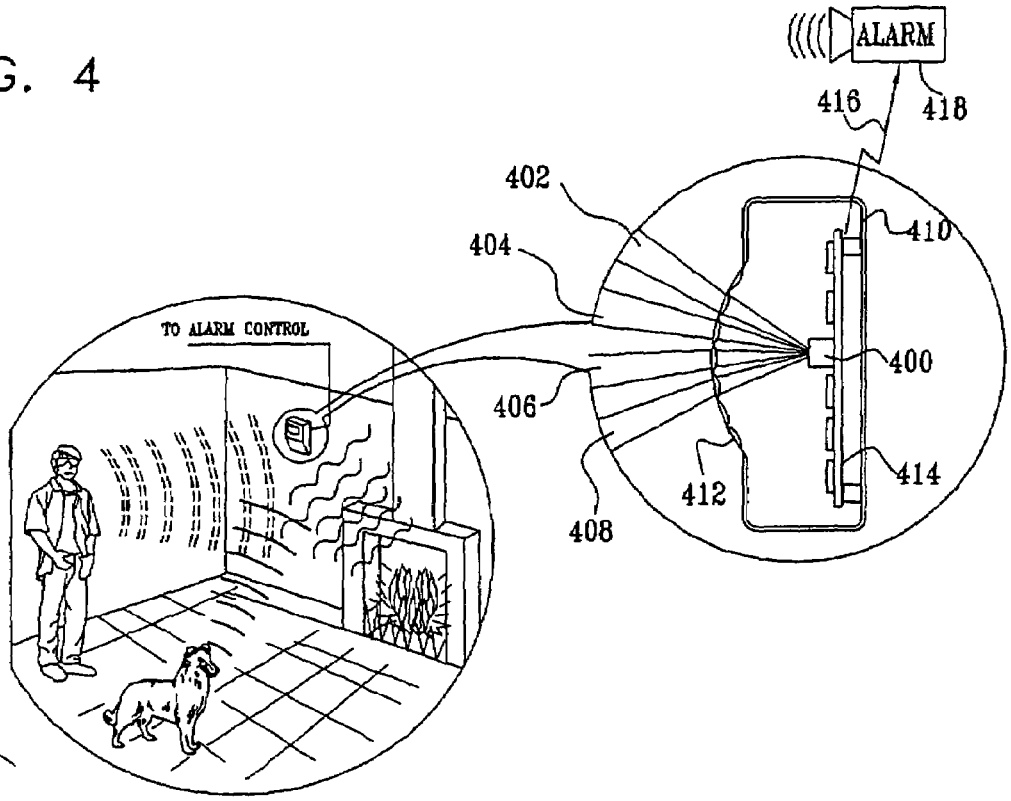

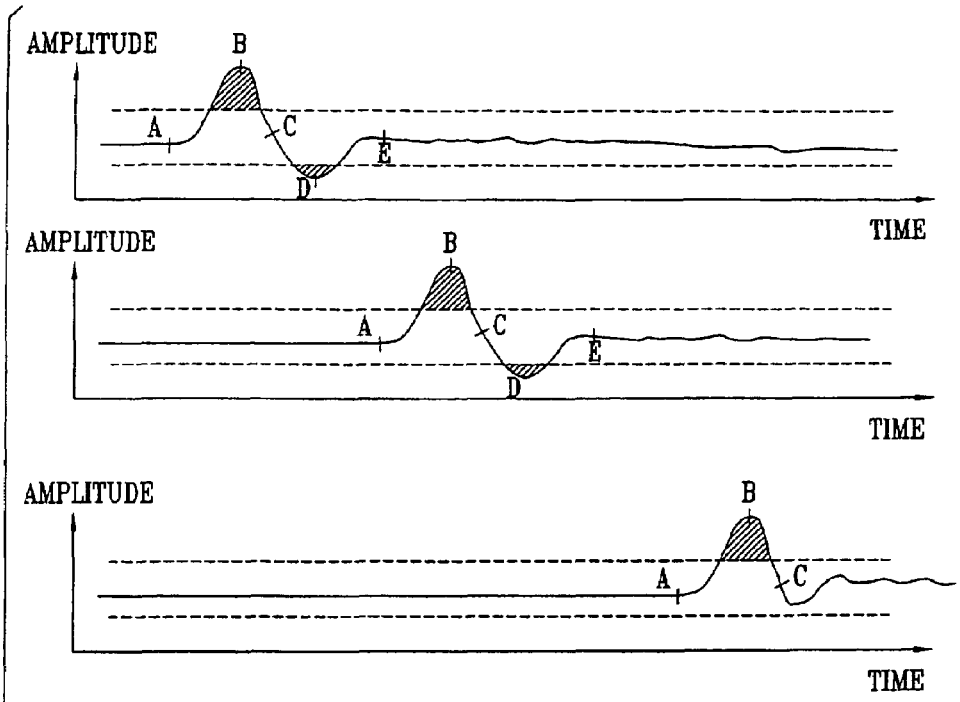
FIG. 14
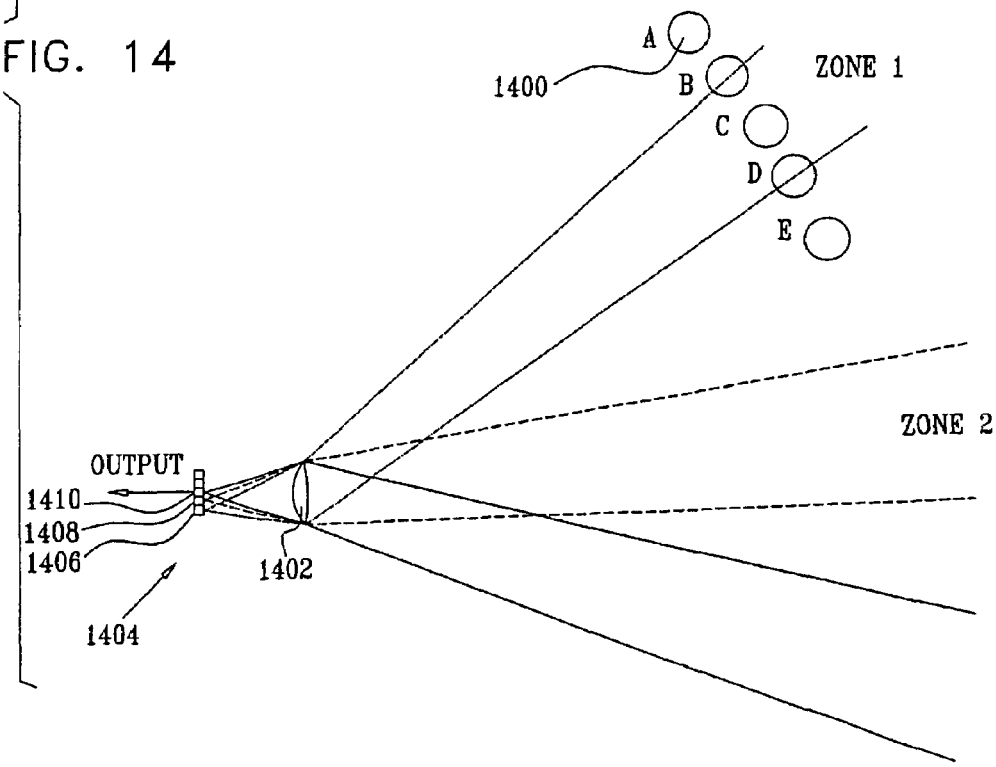

MOTION DETECTION APPARATUS EMPLOYING MILLIMETER WAVE DETECTOR

REFERENCE TO CO-PENDING APPLICATION

This application claims priority from U.S. Provisional Patent Application Ser. No. 60/281,209, filed Apr. 3, 2001 and entitled MILLIMETER WAVE HUMAN MOVEMENT DETECTOR, the disclosure of which is hereby incorporated by reference.

FIELD OF THE INVENTION

The present invention relates to motion detection systems and methods generally which are useful for example in intrusion detection, access control, and energy management.

BACKGROUND OF THE INVENTION

Detection and imaging of millimeter wave electromagnetic radiation, e.g. radiation having a wavelength between approximately 0.05 mm and 10 mm, is known.

The following patents are believed to represent the current state of the art:

U.S. Pat. Nos. 5,815,113; 5,555,036; 5,530,247; 5,202,692; 5,182,564 and 4,510,622.

SUMMARY OF THE INVENTION

The present invention seeks to provide an improved system and method for motion detection which are useful for example in intrusion detection, access control, and energy management.

There is thus provided in accordance with a preferred embodiment of the present invention a motion detection apparatus including an incoherent detector, including at least one sensing element, operative to detect receipt of radiation having a wavelength between 0.05 mm and 10 mm from multiple fields of view, and a motion detector receiving an output of the incoherent detector and providing a motion detection output indicating receipt of radiation from an object moving between the multiple fields of view.

There is also provided in accordance with another preferred embodiment of the present invention an intrusion detection system including an incoherent detector operative to detect receipt of radiation having a wavelength between 0.05 mm and 10 mm and an intrusion detector receiving an output of the incoherent detector and providing an intrusion detection output indicating receipt of radiation from an object whose intrusion is sought to be detected.

There is further provided in accordance with yet another preferred embodiment of the present invention an access control system including an incoherent detector operative to detect receipt of radiation having a wavelength between 0.05 mm and 10 mm and an access control detector receiving an output of the incoherent detector and providing an access control Output indicating receipt of radiation from an object.

There is also provided in accordance with still another preferred embodiment of the present invention an energy management system including an incoherent detector operative to detect receipt of radiation having a wavelength between 0.05 mm and 10 mm and an energy management detector receiving an output of the incoherent detector and providing an energy management output indicating receipt of radiation from an object.

There is further provided in accordance with another preferred embodiment of the present invention a method for motion detection including detecting receipt of radiation having a wavelength between 0.05 mm and 10 mm from multiple fields of view, utilizing an incoherent detector, including at least one sensing element, receiving an output of the incoherent detector and providing a motion detection output indicating receipt of radiation from an object moving between the multiple fields of view.

There is yet further provided in accordance with yet another preferred embodiment of the present invention a method for intrusion detection including detecting receipt of radiation having a wavelength between 0.05 mm and 10 mm, utilizing an incoherent detector, receiving an output of the incoherent detector and providing an intrusion detection output indicating receipt of radiation from an object whose intrusion is sought to be detected.

There is also provided in accordance with still another preferred embodiment of the present invention a method for access control including detecting receipt of radiation having a wavelength between 0.05 mm and 10 mm, utilizing an incoherent detector, receiving an output of the incoherent detector and providing an access control output indicating receipt of radiation from an object.

There is further provided in accordance with another preferred embodiment of the present invention a method for energy management including detecting receipt of radiation having a wavelength between 0.05 mm and 10 mm, utilizing an incoherent detector, receiving an output of the incoherent detector and providing an energy management output indicating receipt of radiation from an object.

Preferably, the motion detector provides the motion detection output indicating receipt of radiation from the object at at least two different times having at least a predetermined time relationship therebetween.

In accordance with a preferred embodiment, the incoherent detector is operative to detect radiation emitted by a human. Additionally, the motion detector is operative to sense differences between radiation received from humans and from other objects and to provide the motion detection output at least partially based on the differences. Alternatively, the motion detector is operative to sense differences between radiation received from humans and from pets and to provide the motion detection output at least partially based on the differences.

Preferably, the motion detector is operative to sense differences between radiation received from humans and from other objects by comparing the amplitude of received radiation. Alternatively, the motion detector is operative to sense differences between radiation received from humans and from other objects by comparing characteristics of received radiation. Additionally or alternatively, the motion detector is operative to sense differences between radiation received from humans and from other objects by comparing patterns of received radiation. Alternatively, the motion detector is operative to sense differences between radiation received from humans and from other objects by comparing shapes of received radiation. Additionally, the motion detector is operative to sense differences between radiation received from humans and from other objects by comparing the amplitude of received radiation at multiple wavelengths over time.

In accordance with another preferred embodiment, the apparatus also includes at least one optical element upstream of the incoherent detector. Preferably, the at least one optical element includes at least one lens. Alternatively, the at least one optical element includes at least one reflector. Additionally or alternatively, the at least one optical element includes at least one waveguide. In accordance with another preferred embodiment, the at least one optical element includes a plurality of optical elements, each operative at a different wavelength range.

In accordance with yet another preferred embodiment, the apparatus also includes intrusion detection circuitry receiving an input from an output from the motion detector and providing an intrusion detection output based at least partially thereon. Alternatively, the apparatus includes access control circuitry receiving an input from an output from the motion detector and providing an access control circuit output based at least partially thereon. Additionally or alternatively, the apparatus also includes energy management circuitry receiving an input from an output from the motion detector and providing an energy management output based at least partially thereon.

In accordance with yet another preferred embodiment, the apparatus also includes an illuminator providing radiation having a wavelength between 0.05 mm and 10 mm into a protected region which is viewed by the incoherent detector. Alternatively, the apparatus also includes an active detector operative to detect receipt of radiation having a wavelength between 0.05 mm and 10 mm.

BRIEF DESCRIPTION OF THE DRAWINGS

The present invention will be understood and appreciated more fully from the following detailed description, taken in conjunction with the drawings in which:

FIG. 4 is a simplified pictorial illustration of a motion detection system employing millimeter wave motion detection in accordance with a preferred embodiment of the present invention;

FIG. 14 is a simplified illustration of a detector output produced by motion of an object through multiple spaced fields of view in accordance with another preferred embodiment of the present invention;

DETAILED DESCRIPTION OF PREFERRED EMBODIMENTS

Figure 1:
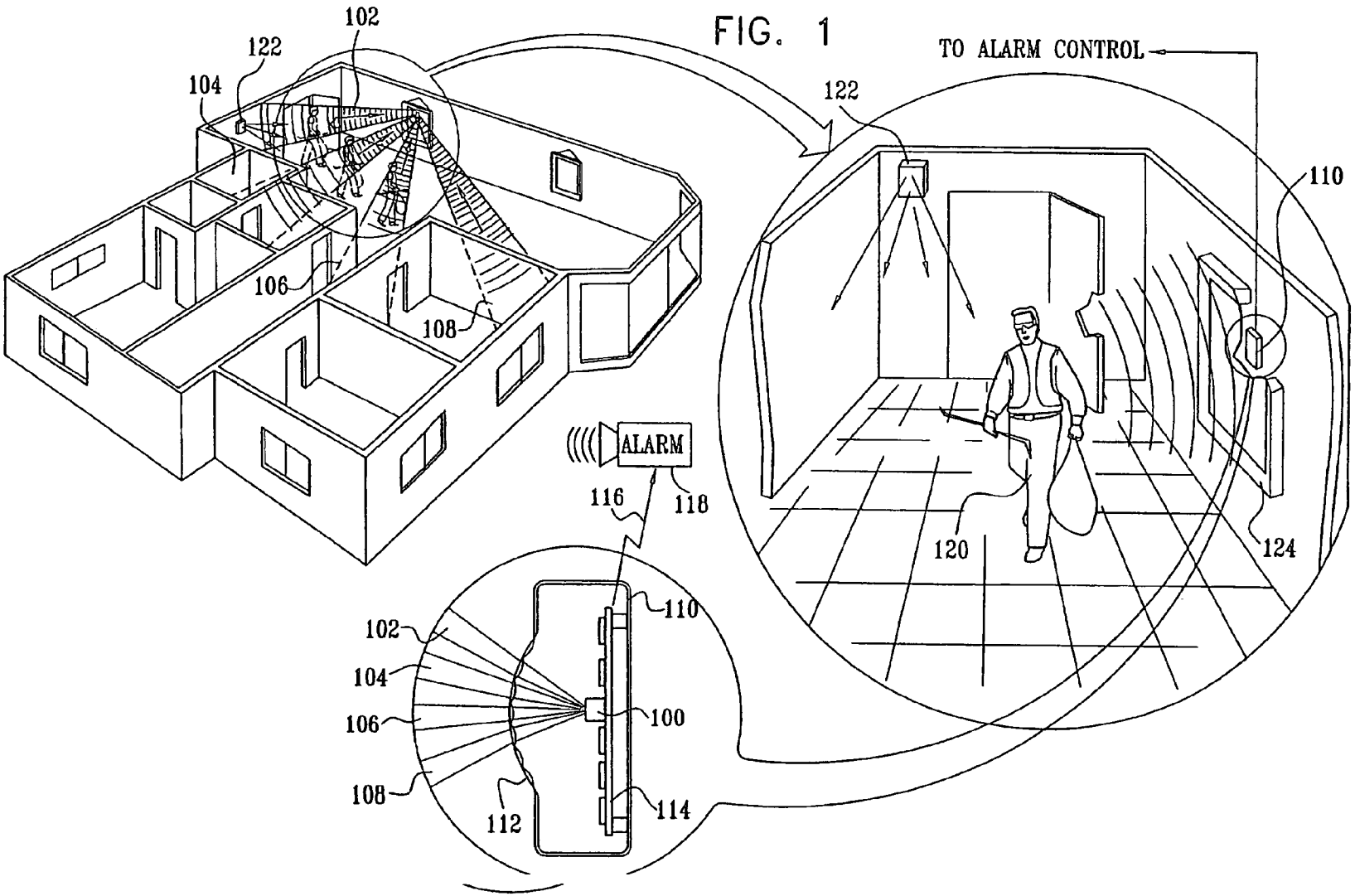
FIG. 1 is a simplified pictorial illustration of an intrusion detection system employing millimeter wave motion detection in accordance with a preferred embodiment of the present invention.

Reference is now made to FIG. 1, which is a simplified pictorial illustration of an intrusion detection system employing millimeter wave motion detection in accordance with a preferred embodiment of the present invention. As seen in FIG. 1, there is preferably provided a motion detection system particularly, but not exclusively, useful for intrusion detection and including at least one incoherent detector 100 operative to detect receipt of radiation having a wavelength between 0.05 mm and 10 mm from multiple spaced fields of view, here designated 102, 104, 106 and 108.

As will be described hereinbelow, a suitable incoherent detector 100 is a PY55 CM Series Detector, commercially available from Goodrich Corporation, 100 Wooster Heights Rd, Danbury, Conn. 06810 U.S.A. This incoherent detector 100 is preferably located within a housing 10 incorporating radiation input optics, such as a lens array 112, which defines the multiple spaced fields of view 102–108. The lens array 112 may be formed of polyethylene, TEFLON R, or POLY IR R materials, commercially available from Fresnel Technologies, Inc. of 101 West Morningside Drive, Fort Worth, Tex. 76110 U.S.A.

The incoherent detector 100 preferably outputs to motion detector circuitry 114, which typically includes a microprocessor and provides a motion detection output 116, which may be provided to an alarm indicator 118. The motion detection output 116 preferably indicates receipt of radiation from an object whose motion is sought to be detected, preferably a human 120. The radiation is received preferably at at least two different times having at least a predetermined time relationship therebetween. Preferably the detection of radiation at at least two different times is produced by motion of the human through multiple spaced fields of view, as shown.

It is appreciated that the system and methodology illustrated in FIG. 1 may operate based on detection of radiation in the wavelength range of between 0.05 mm and 10 mm emitted by a human or other object. Alternatively or additionally, the system and methodology illustrated in FIG. 1 may operate based on detection of radiation in the wavelength range of between 0.05 mm and 10 mm reflected by the human or other object. In such a case, a suitable illuminator 122 may be provided to enhance the amount of reflected radiation.

It is noted that a particular feature of the present invention is that the detected radiation in the wavelength range of between 0.05 mm and 10 mm is capable of passing through many objects. Accordingly, the detector 100, its housing 110 and the detector circuitry 114 may be hidden from ordinary view, as by being located behind a picture 124 or other object.

Figure 2:
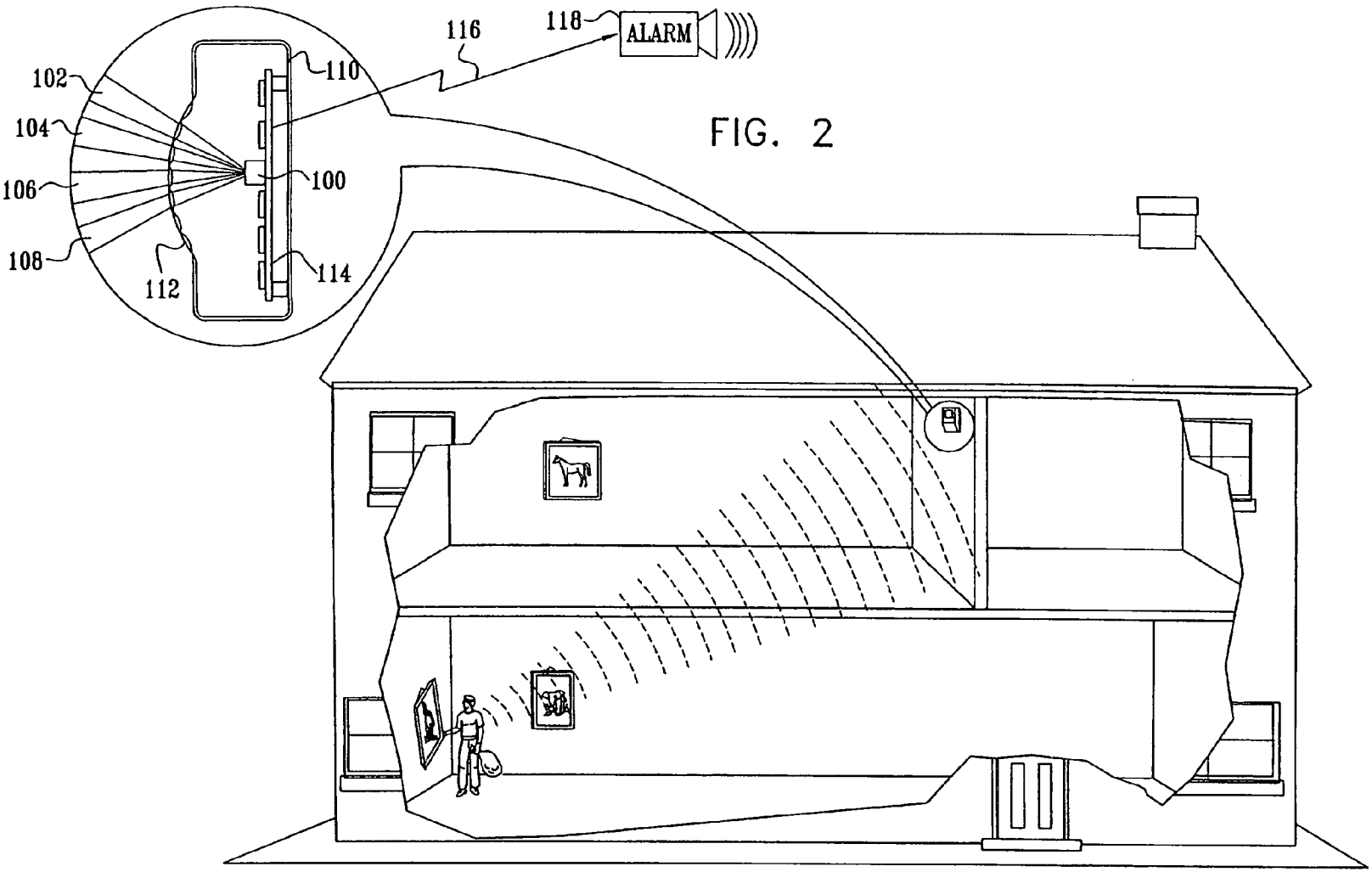
FIG. 2 is a simplified pictorial illustration of the intrusion detection system employing millimeter wave motion detection of FIG. 1 in another environment.

Reference is now made to FIG. 2, which is a simplified pictorial illustration of the intrusion detection system of FIG. 1 in a somewhat different environment, which illustrates that the detected radiation in the wavelength range of between 0.05 mm and 10 mm is capable of passing through floors, ceilings and walls of buildings. Accordingly, the detector 100, its housing 110 and the detector circuitry 114 may be located at a single location within a building and nevertheless provide intrusion detection throughout the building.

Figure 3A:
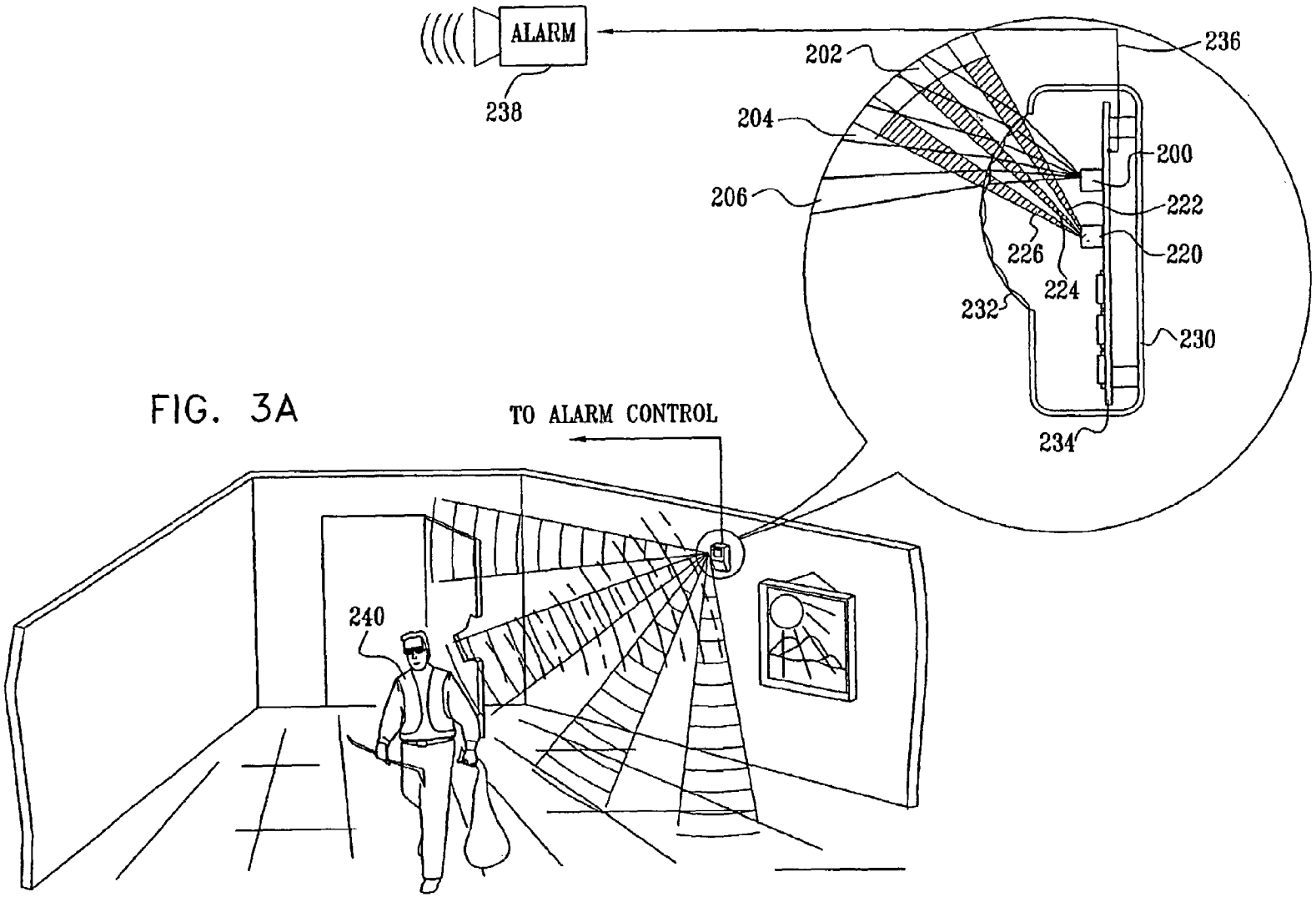
FIGS. 3A and 3B are simplified pictorial illustrations of two alternative types of dual mode intrusion detection systems employing millimeter wave motion detection in accordance with a preferred embodiment of the present invention.

Reference is now made to FIG. 3A, which is a simplified pictorial illustration of a dual mode intrusion detection system employing millimeter wave motion detection in accordance with a preferred embodiment of the present invention. As seen in FIG. 3A, there is preferably provided a motion detection system particularly, but not exclusively, useful for intrusion detection and including at least one incoherent detector 200 operative to detect receipt of radiation having a wavelength between 0.05 mm and 10 mm from multiple spaced fields of view, here designated 202, 204 and 206. As will be described hereinbelow, a suitable incoherent detector 200 is a PY55 CM Series Detector, commercially available from Goodrich Corporation, 100 Wooster Heights Rd, Danbury, Conn. 06810 U.S.A.

In the embodiment of FIG. 3A, there is also provided at least one additional incoherent detector 220 operative to detect receipt of radiation having a wavelength in a range other than the range of between 0.05 mm and 10 mm from multiple spaced fields of view, here designated 222, 224 and 226. Detector 220 is typically operative to detect receipt of radiation having a wavelength between 0.1 mm and 0.5 mm, alternatively between 0.01 and 0.1 mm, or further alternatively between 0.001 and 0.015 mm.

Detectors 200 and 220 are preferably located within a housing 230 incorporating radiation input optics, such as a lens array 232, which defines the multiple spaced fields of view 202–206 and 222–226. As a further alternative, a single detector may be employed with plural parallel arranged input radiation filters.

The incoherent detectors 200 and 220 preferably output to motion detector circuitry 234, which typically includes a microprocessor and provides a motion detection output 236, which may be provided to an alarm indicator 238. The motion detection output 236 preferably indicates receipt of radiation from an object whose motion is sought to be detected, preferably a human 240, at at least two different times having at least a predetermined time relationship therebetween and at two different wavelength ranges. Preferably the detection of radiation at at least two different times is produced by motion of the human through multiple spaced fields of view.

It is appreciated that the system and methodology illustrated in FIG. 3A may operate at least partially based on detection of radiation emitted by and/or reflected from a human or other object and passing through visually opaque objects.

Figure 3B:
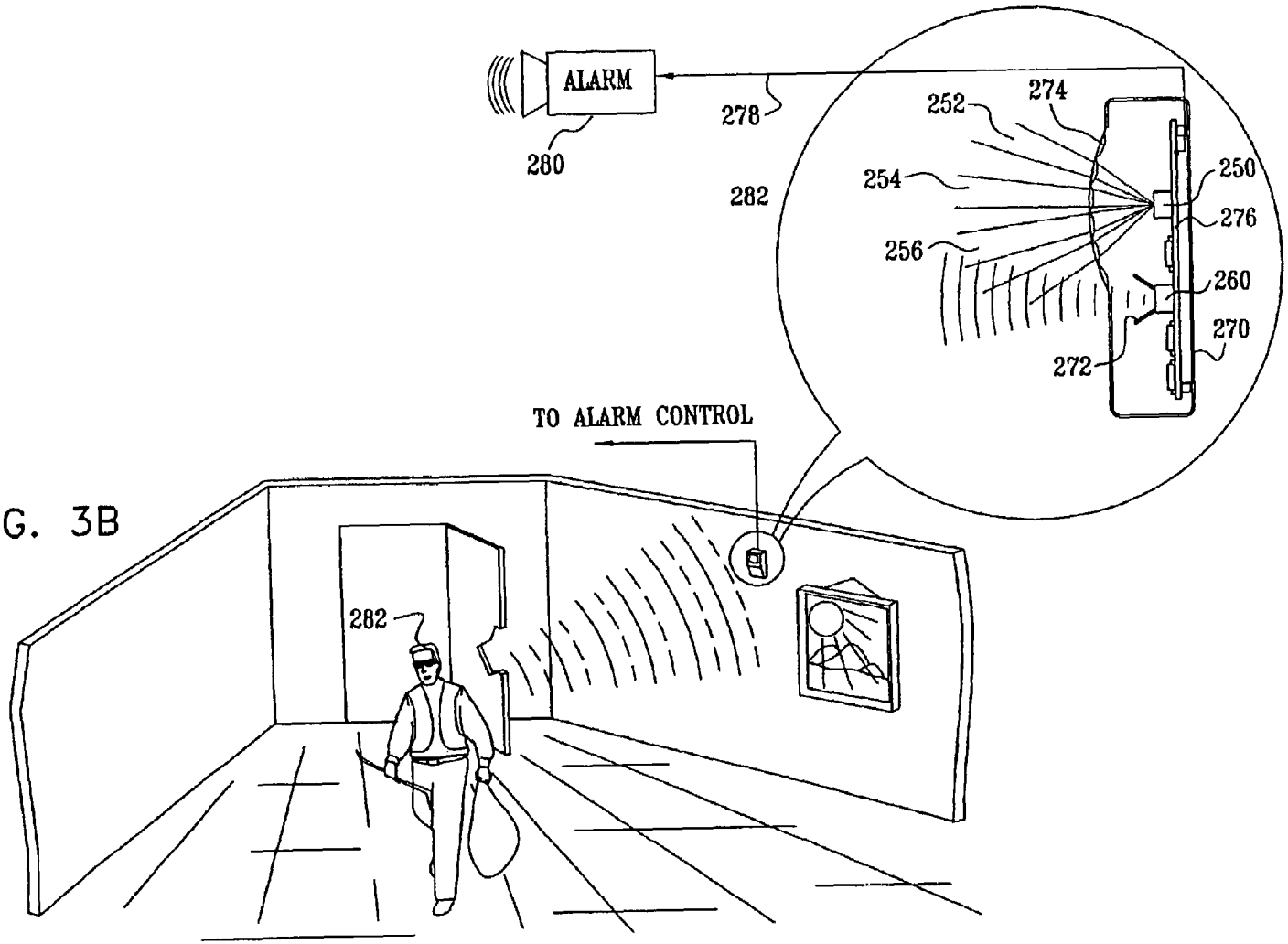

Reference is now made to FIG. 3B, which is a simplified pictorial illustration of a dual mode intrusion detection system employing millimeter wave motion detection in accordance with a preferred embodiment of the present invention. As seen in FIG. 3B, there is preferably provided a motion detection system particularly but not exclusively useful for intrusion detection and including at least one incoherent detector 250 operative to detect receipt of radiation having a wavelength between 0.05 mm and 10 mm from multiple spaced fields of view, here designated 252, 254 and 256. As will be described hereinbelow, a suitable incoherent detector 250 is a PY55 CM Series Detector, commercially available from Goodrich Corporation, 100 Wooster Heights Rd, Danbury, Conn. 06810 U.S.A.

In the embodiment of FIG. 3B, there is also provided at least one active coherent detector 260 such as a microwave detector operative to transmit and detect radiation having a frequency in the range of 0.5–30 gigahertz. Alternatively or additionally, the active coherent detector 260 may be an active millimeter wave detector or any other suitable active detector such as an optical detector.

Detectors 250 and 260 are preferably located within a housing 270 incorporating an antenna 272 for coherently transmitting and receiving radiation as well as radiation input optics, such as a lens array 274, which defines the multiple spaced fields of view 252–256.

The detectors 250 and 260 preferably output to motion detector circuitry 276, which typically includes a microprocessor and provides a motion detection output 278, which may be provided to an alarm indicator 280. The motion detection output 278 preferably indicates receipt of radiation from an object whose motion is sought to be detected, preferably a human 282, at at least two different times having at least a predetermined time relationship therebetween and at two different wavelength ranges. Preferably the detection of radiation at at least two different times is produced by motion of the human through multiple spaced fields of view.

It is appreciated that the system and methodology illustrated in FIG. 3B may operate at least partially based on detection of radiation emitted by and/or reflected from a human or other object and passing through visually opaque objects.

Reference is now made to FIG. 4, which is a simplified pictorial illustration of a motion detection system employing millimeter wave motion detection in accordance with a preferred embodiment of the present invention. FIG. 4 shows an environment including multiple sources of radiation in the range of between 0.05 mm and 10 mm. At a first time, designated A, a pet and a heater in a room both emit radiation in the range of between 0.05 mm and 10 mm. At a later time, designated B, a thief enters the room.

As in the embodiment of FIG. 1, there is preferably provided a motion detection system particularly, but not exclusively, useful for intrusion detection and including at least one incoherent detector 400 operative to detect receipt of radiation having a wavelength between 0.05 mm and 10 mm from multiple spaced fields of view, here designated 402, 404, 406 and 408.

As will be described hereinbelow, a suitable incoherent detector 400 is a PY55 CM Series Detector, commercially available from Goodrich Corporation, 100 Wooster Heights Rd, Danbury, Conn. 06810 U.S.A. This incoherent detector 400 is preferably located within a housing 410 incorporating radiation input optics, such as a lens array 412, which defines the multiple spaced fields of view 402–408.

The incoherent detector 400 preferably outputs to motion detector circuitry 414, which typically includes a microprocessor and provides a motion detection output 416, which may be provided to an alarm indicator 418.

The output of incoherent detector 400 includes a signal whose amplitude, shape and pattern are characteristic of the radiation detected thereby at any given time. Thus, as shown in FIG. 4, at time A, the output signal includes signal portions, which are labeled to identify them with the pet and the heater.

At time B, the output signal includes additional signal portions, which are characteristic of motion of the thief and are labeled accordingly.

It is a particular feature of the present invention, that the signal portions which are characteristic of motion of a human may be distinguished from those characteristic of a pet by at least one and preferably more than one of the following signal characteristics: amplitude, shape and pattern.

It is seen that amplitude thresholding alone might not be able to distinguish a signal portion 450, characteristic of a jumping pet, from signal portions 452 and 454, characteristic of human motion. Shape analysis, does however distinguish signal portion 450, which is narrow, from signal portions 452 and 454, which are significantly wider.

Similarly, pattern analysis, which measures elapsed time between signal portions, identifies signal portions 452 and 454 as indicating human motion, since their time relationship corresponds to the usual speed of human motion across at least partially spatially separated fields of view.

It is appreciated that the system and methodology illustrated in FIG. 4 may operate at least partially based on detection of radiation emitted by and/or reflected from a human or other object and passing through visually opaque objects.

Figure 5:
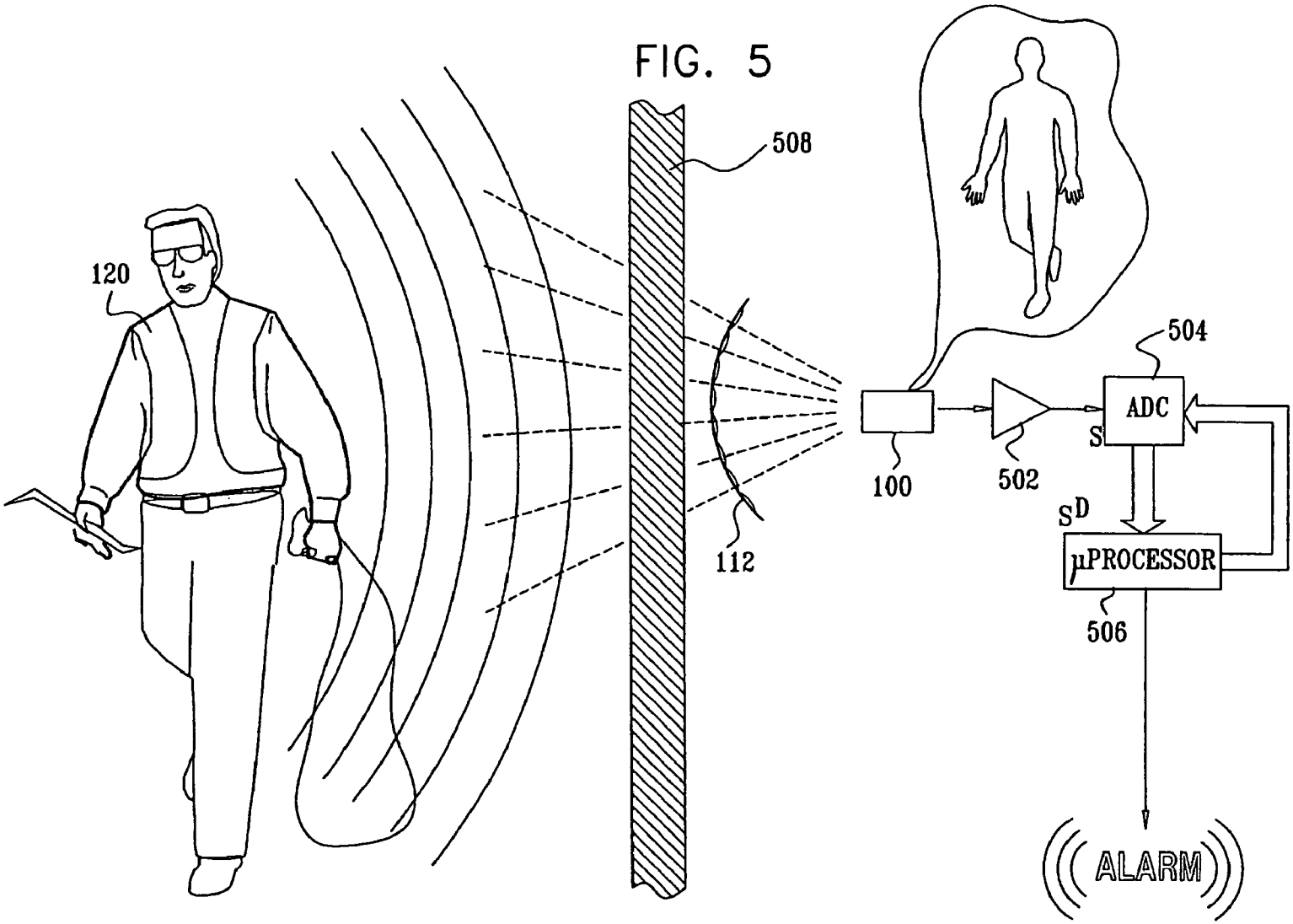
FIG. 5 is a simplified partially pictorial, partially block diagram illustration of a motion detection system employing millimeter wave motion detection in accordance with a preferred embodiment of the present invention.

Reference is now made to FIG. 5, which is a simplified partially pictorial, partially block diagram illustration of a motion detection system employing millimeter wave motion detection in accordance with a preferred embodiment of the present invention of the type shown in FIG. 1. As seen in FIG. 5, incoherent detector 100 (FIG. 1) views a human 120 (FIG. 1) through an opaque material 508 and lens array 112, which defines the multiple spaced fields of view 102–108, as in FIG. 1.

As shown in FIG. 5, the incoherent detector 100 "sees" the human without his clothing or other accouterments. The output of incoherent detector 100 is preferably output via an amplifier 502 and an analog-to-digital converter 504 to a microprocessor 506, which are all part of motion detector circuitry 114 shown in FIG. 1. According to an alternative embodiment of the present invention, the functionalities of the amplifier 502 and of the analog-to-digital converter 504 may be provided by the microprocessor 506. In such case the amplifier 502 and the analog-to-digital converter 504 may be obviated. The microprocessor 506 preferably provides an alarm indicating motion detection output 116, as seen in FIG. 1.

Figure 6:
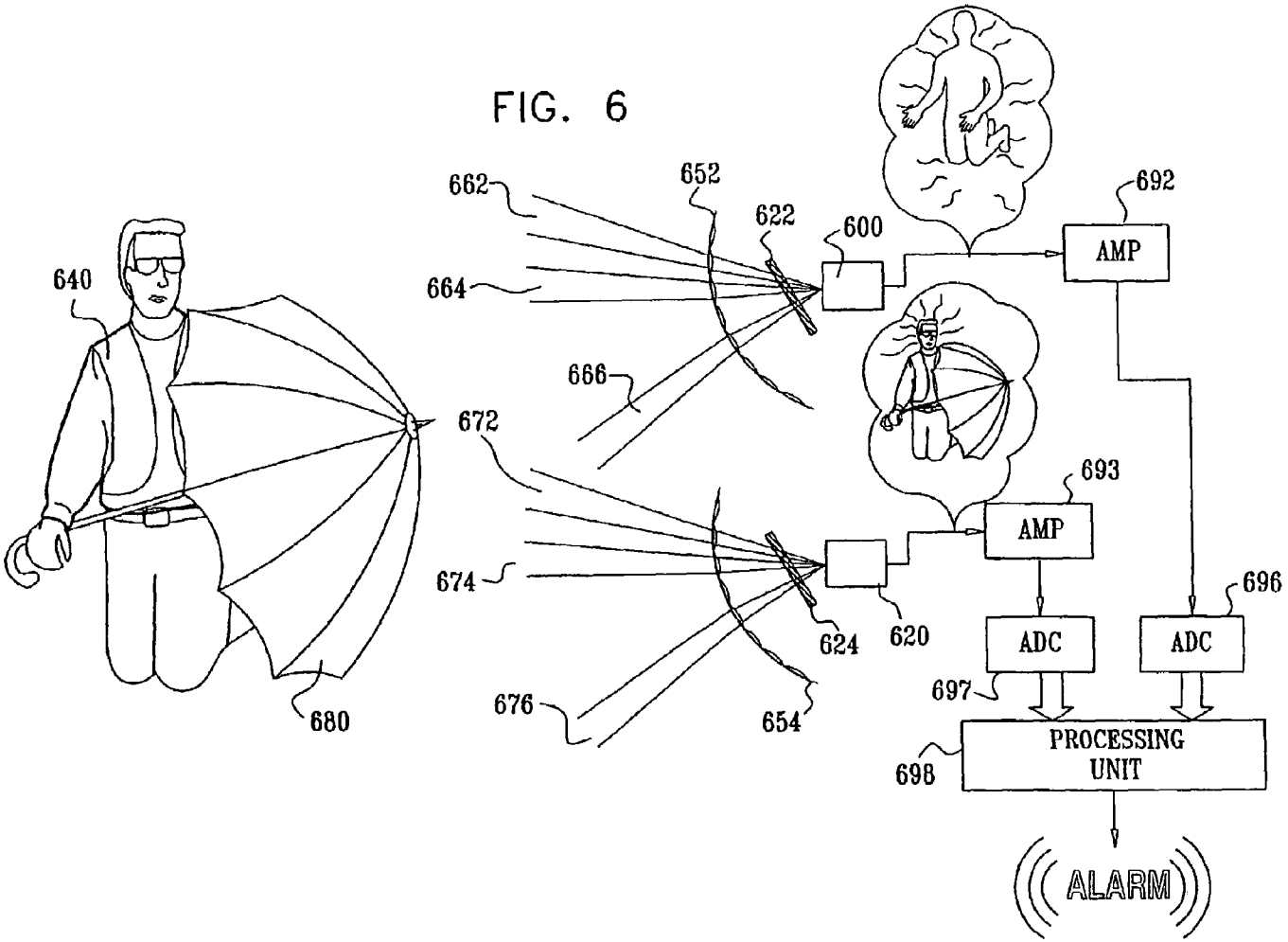
FIG. 6 is a simplified partially pictorial, partially block diagram illustration of a single/dual mode motion detection system employing millimeter wave motion detection in accordance with another preferred embodiment of the present invention.

Reference is now made to FIG. 6, which is a simplified partially pictorial, partially block diagram illustration of a motion detection system employing millimeter wave motion detection in accordance with a preferred embodiment of the present invention of the general type shown in FIG. 3A. As seen in FIG. 6, incoherent detectors 600 and 620, which may be associated with respective filters 622 and 624, view a human 640 (FIG. 3A) through respective lens arrays 652 and 654, each of which define multiple spaced fields of view 662–666 and 672–676.

As shown in FIG. 6, the incoherent detector 600 "sees" the human without his clothing or other accouterments. The incoherent detector 620, which here is assumed to be a passive infrared detector, sees the human to the extent that he is not masked by his clothing and by an umbrella 680 which he may be carrying.

The outputs of incoherent detectors 600 and 620 are preferably output via respective amplifiers 692 and 693 and respective analog-to-digital converter 696 and 697 to a microprocessor 698, which are all part of motion detector circuitry 234 of FIG. 3A. According to an alternative embodiment of the present invention, the functionalities of the amplifiers 692 and 694 and of the analog-to-digital converters 696 and 697 may be provided by the microprocessor 698. In such case the amplifiers 692 and 694 and the analog-to-digital converters 696 and 697 may be obviated. The microprocessor 698 preferably provides an alarm indicating motion detection output 236, as seen in FIG. 3A.

Figure 7:
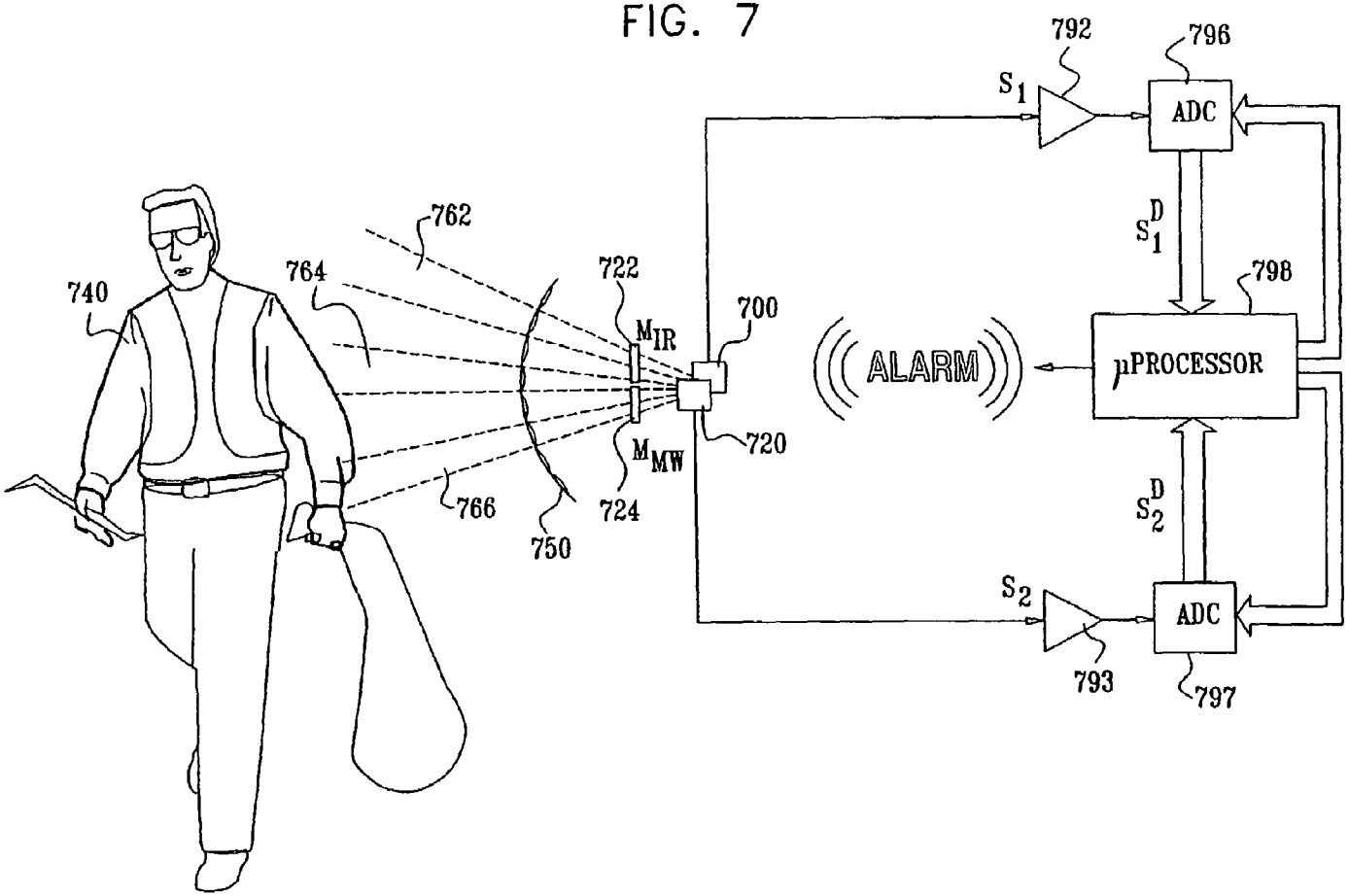
FIG. 7 is a simplified partially pictorial, partially block diagram illustration of a motion detection system employing millimeter wave motion detection in accordance with a preferred embodiment of the present invention.

Reference is now made to FIG. 7, which is a simplified partially pictorial, partially block diagram illustration of a motion detection system employing millimeter wave motion detection in accordance with another preferred embodiment of the present invention of the general type shown in FIG. 3A. As seen in FIG. 7, incoherent detectors 700 and 720, which may be associated with respective filters 722 and 724, view a human 740 through a common lens array 750, which defines multiple spaced fields of view 762–766.

The outputs of incoherent detectors 700 and 720 are preferably output via respective amplifiers 792 and 793 and respective analog-to-digital converters 796 and 797 to a microprocessor 798, which are all part of motion detector circuitry 234 (FIG. 3A). According to an alternative embodiment of the present invention, the functionalities of the amplifiers 792 and 794 and of the analog-to-digital converters 796 and 797 may be provided by the microprocessor 798. In such case the amplifiers 792 and 794 and the analog-to-digital converters 796 and 797 may be obviated. The microprocessor 798 preferably provides an alarm indicating motion detection output 236, as seen in FIG. 3A.

Figure 8:
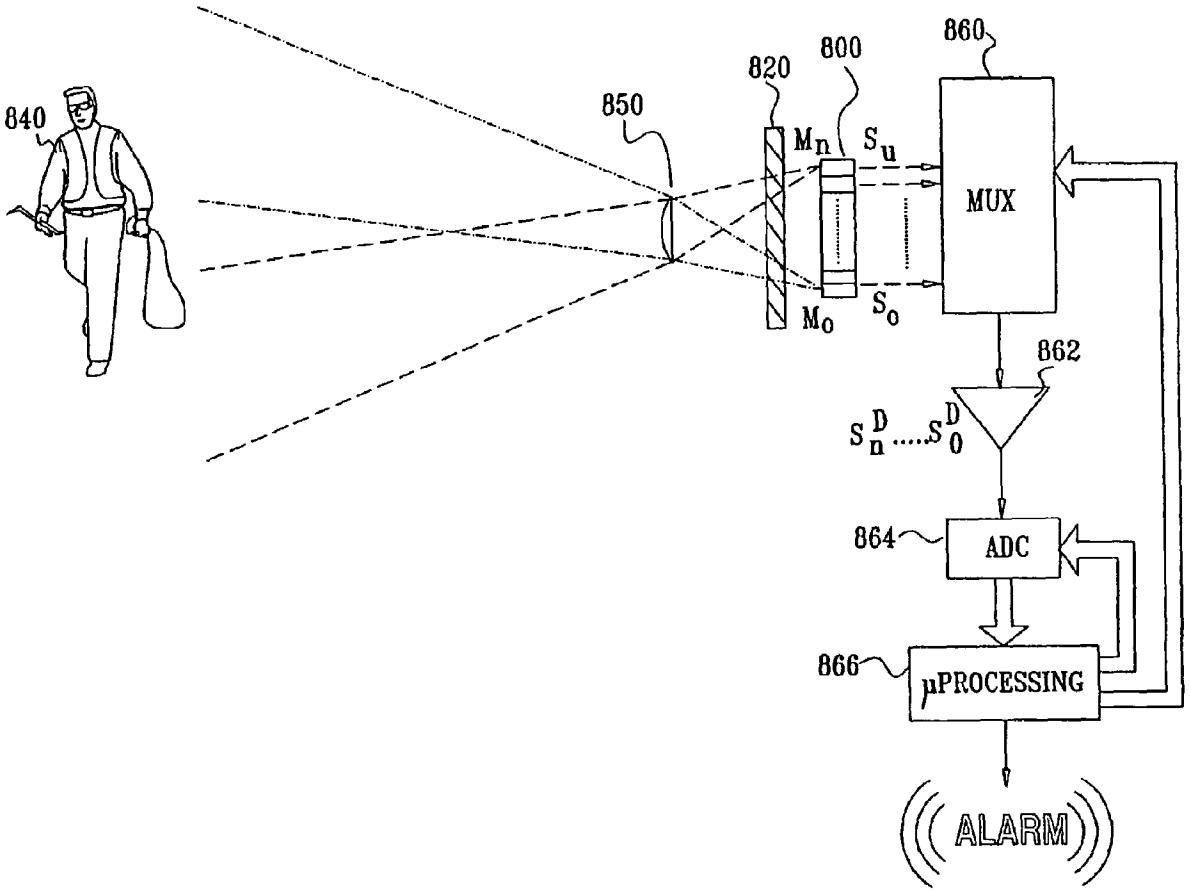
FIG. 8 is a simplified partially pictorial, partially block diagram illustration of a motion detection system employing millimeter wave motion detection in accordance with another preferred embodiment of the present invention.

Reference is now made to FIG. 8, which is a simplified partially pictorial, partially block diagram illustration of a motion detection system employing millimeter wave motion detection in accordance with another preferred embodiment of the present invention of the general type shown in FIG. 3A. As seen in FIG. 8, an incoherent detector array 800, which may be associated with a filter 820, views a human 840 through a common lens 850.

The outputs of incoherent detector array 800 are supplied to a signal multiplexer 860 and thence via an amplifier 862 and an analog-to-digital converter 864 to a microprocessor 866, which are all part of motion detector circuitry 234 of FIG. 3A. According to an alternative embodiment of the present invention, the functionalities of the amplifier 862 and of the analog-to-digital converter 864 may be provided by the microprocessor 866. In such case the amplifier 862 and the analog-to-digital converter 864 may be obviated. The microprocessor 866 preferably provides an alarm indicating motion detection output 236, as seen in FIG. 3A.

Figure 9A:
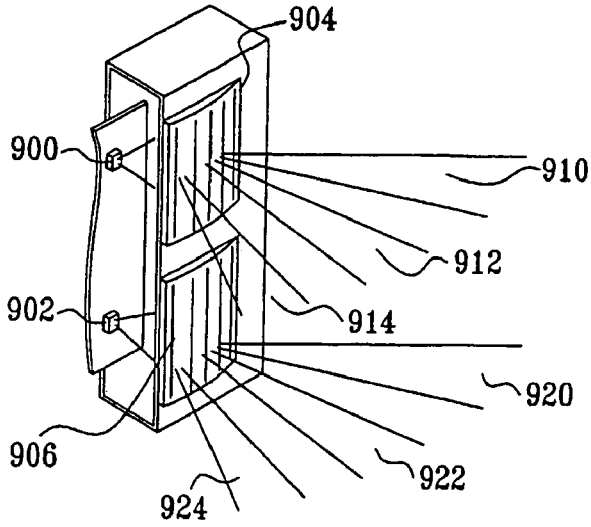
FIGS. 9A, 9B and 9C illustrate three alternative embodiments of motion detector systems employing millimeter wave motion detection in accordance with a preferred embodiment of the present invention.
Figure 9B:
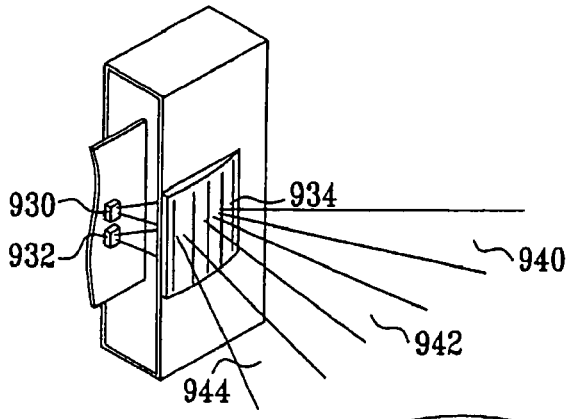
Figure 9C:
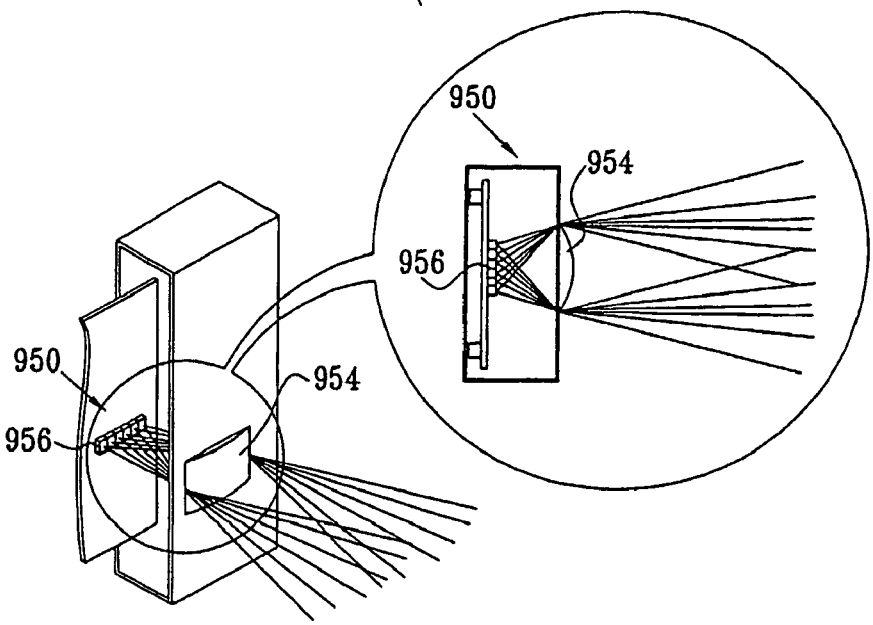

Reference is now made to FIGS. 9A, 9B and 9C, which illustrate three alternative embodiments of motion detector systems employing millimeter wave motion detection in accordance with a preferred embodiment of the present invention. FIG. 9A, which corresponds to the embodiment of FIG. 6, shows the use of two detectors 900 and 902, each viewing a protected area through a respective lens array, here designated 904 and 906, each of which defines multiple spaced fields of view, here designated 910, 912 & 914 and 920, 922 and 924.

FIG. 9B, which corresponds to the embodiment of FIG. 7, shows the use of two detectors 930 and 932, each viewing a protected area through a common lens array 934 which defines multiple spaced fields of view, here designated 940, 942 & 944.

FIG. 9C, which corresponds to the embodiment of FIG. 8, shows the use of an array 950 of detectors, viewing a protected area through a common lens 954. Each sensing element 956 of detector array 950 defines a field of view through the lens 954.

Figure 10A:
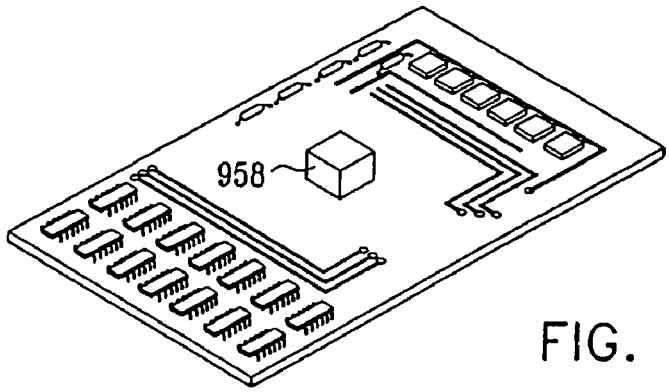
FIGS. 10A, 10B and 10C are simplified illustrations of three alternative embodiments of detector arrangements employed in millimeter wave motion detectors constructed and operative in accordance with a preferred embodiment of the present invention.
Figure 10B:
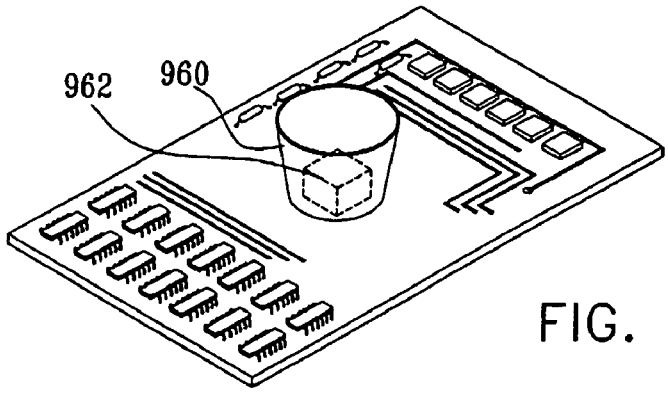
Figure 10C:
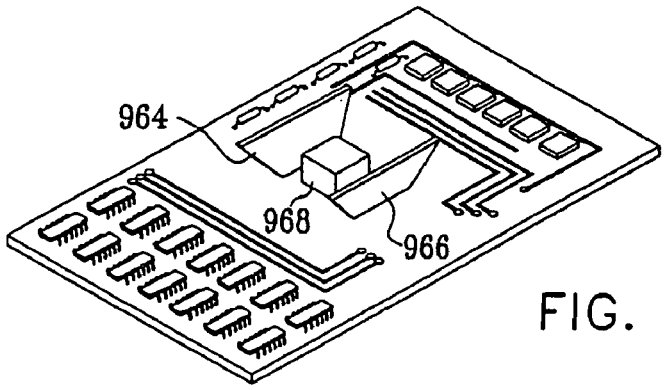

Reference is now made to FIGS. 10A, 10B and 10C, which are simplified illustrations of three alternative embodiments of detector arrangements employed in millimeter wave motion detectors constructed and operative in accordance with a preferred embodiment of the present invention. FIG. 10A shows a detector 958, such as an incoherent detector employed in any of the embodiments of the present invention, mounted onto a printed circuit board without use of a waveguide. FIG. 10B shows a generally conical waveguide 960 surrounding a detector 962. FIG. 10C shows a pair of planar waveguides 964 and 966 adjacent opposite sides of a detector 968. It is appreciated that any suitable waveguide configuration or orientation may be employed in any of the embodiments of the present invention.

Figure 11A:
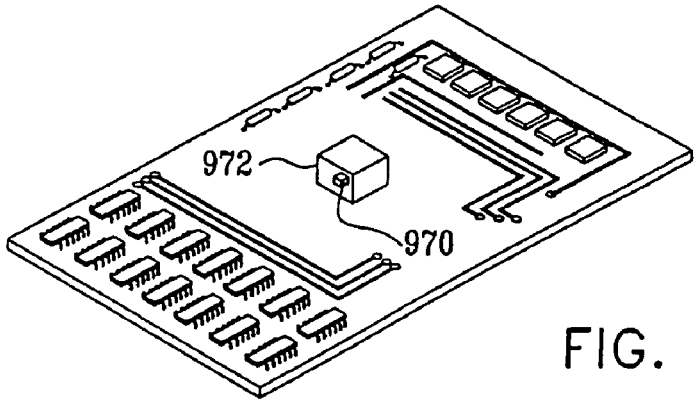
FIGS. 11A, 11B and 11C are simplified illustrations of three alternative embodiments of detectors employed in millimeter wave motion detectors constructed and operative in accordance with a preferred embodiment of the present invention.
Figure 11B:
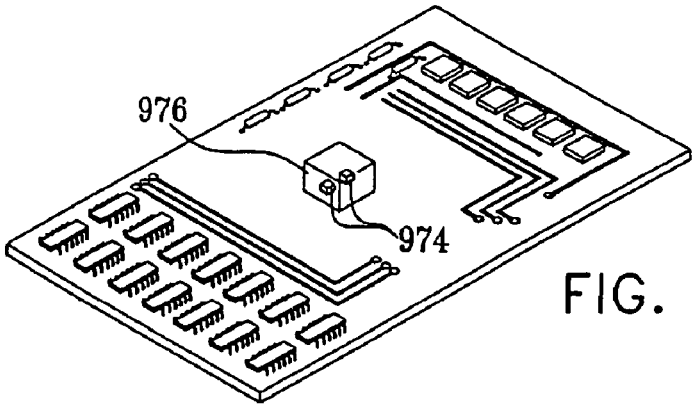
Figure 11C:
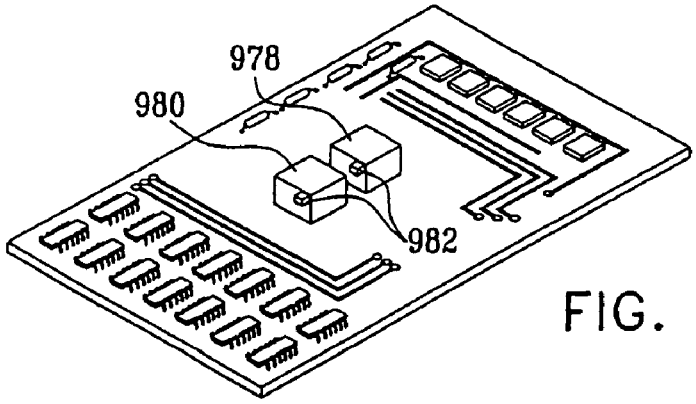

Reference is now made to FIGS. 11A, 11B and 11C, which are simplified illustrations of three alternative embodiments of detectors employed in millimeter wave motion detectors constructed and operative in accordance with a preferred embodiment of the present invention. FIG. 11A shows a single sensing element 970 within a package 972, mounted onto a printed circuit board. FIG. 11B shows a pair of sensing elements 974 located within the same package 976, mounted onto a printed circuit board. FIG. 11C shows a pair of detector packages 978 and 980, each containing a single sensing element 982, being mounted onto a printed circuit board.

Figure 12:
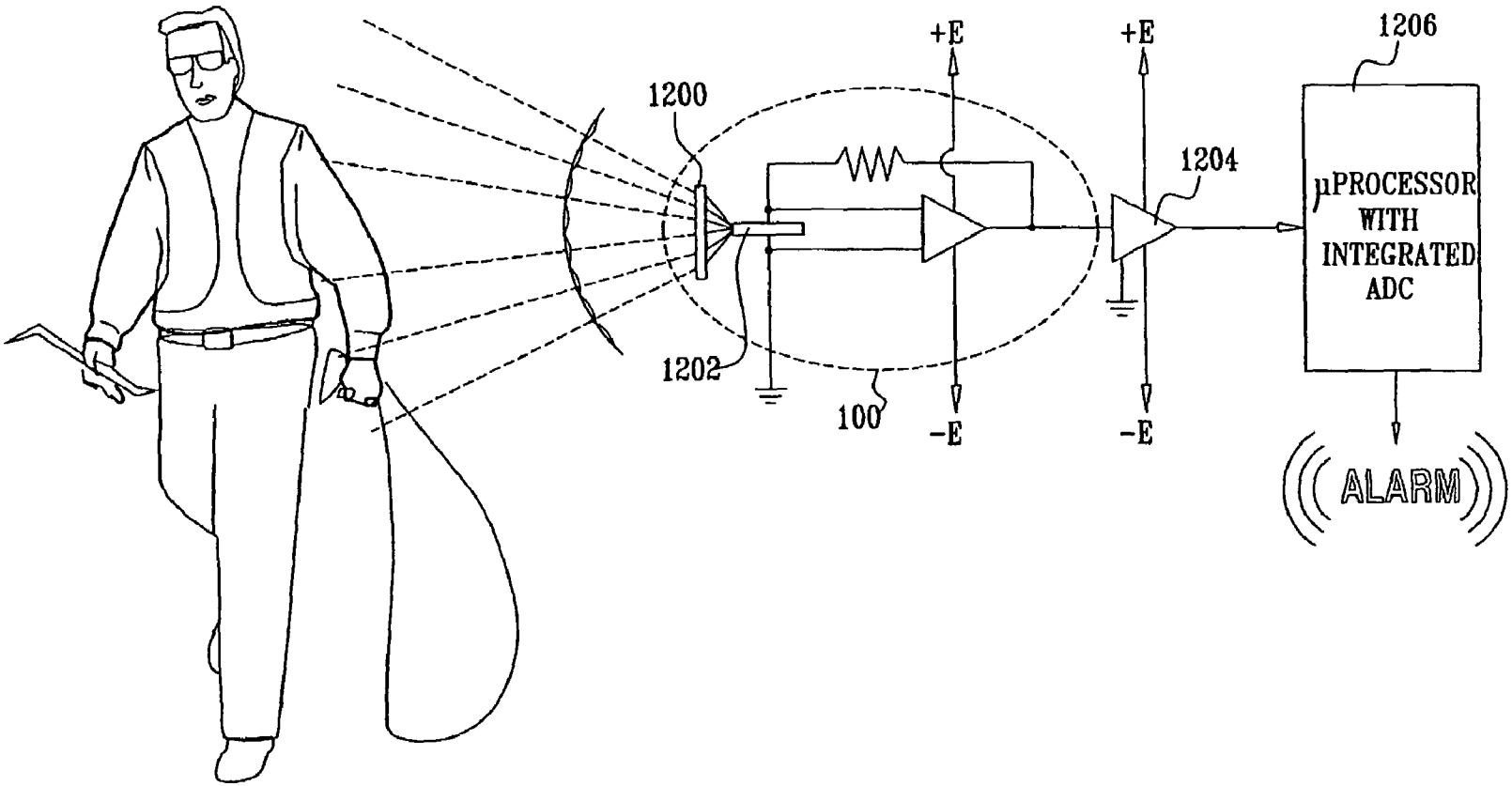
FIG. 12 is a simplified illustration of a motion detector employing millimeter wave motion detection in accordance with a preferred embodiment of the present invention.

Reference is now made to FIG. 12, which is a simplified partially pictorial, partially block diagram illustration of a specific motion detection system employing millimeter wave motion detection in accordance with a preferred embodiment of the present invention of the type shown in FIGS. 1 and 5. As seen in FIG. 12, an incoherent detector 100 (FIG. 1) views a human 120 (FIG. 1) through lens array 112 (FIG. 1), which defines the multiple spaced fields of view 102–108 (FIG. 1).

As shown in FIG. 12, the incoherent detector 100, which is preferably a PY55 CM Series Detector, commercially available from Goodrich Corporation, 100 Wooster Heights Rd, Danbury, Conn. 06810 U.S.A., is seen to comprise a filter 1200 disposed in front of a DLATGS millimeter wave detector 1202 which is interconnected with an amplifier and a resistor within a package and outputs to a pre-amplifier 1204, preferably of the PAPY series, commercially available from Goodrich Corporation, 100 Wooster Heights Rd, Danbury, Conn. 06810 U.S.A. The pre-amplifier 1204 preferably outputs to a microprocessor having an integrated ADC 1206, preferably a PIC16C711, commercially available from Microchip Technologies, Inc. of Chandler, Ariz.

Figure 13:
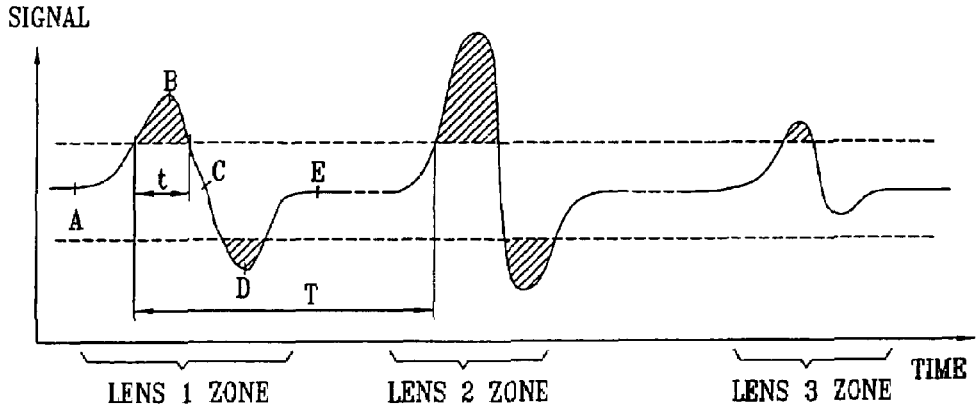
FIG. 13 is a simplified illustration of a detector output produced by motion of an object through multiple spaced fields of view in accordance with a preferred embodiment of the present invention.
Figure 13:
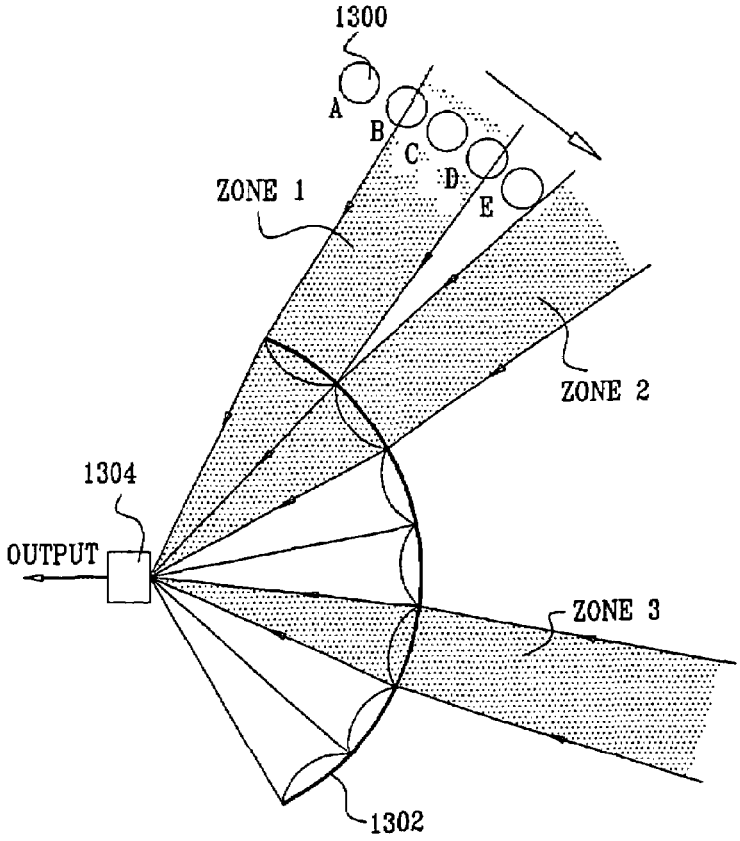

Reference is now made to FIG. 13, which is a simplified illustration of a detector output produced by motion of an object through multiple spaced fields of view in accordance with a preferred embodiment of the invention. As seen in FIG. 13, an object 1300, such as a human, passes through multiple spaced fields of view defined by a lens array 1302 and an incoherent detector 1304, operative to detect receipt of radiation having a wavelength between 0.05 mm and 10 mm.

It is seen that the object 1300 moves into and out of one of the fields of view, here designated zone 1, into a region lying outside the fields of view and thence into another of the fields of view, here designated zone 2 and thence onward. The output of the incoherent detector 1304 is shown and labeled for correspondence with the presence of the object in the various fields of view.

More particularly, it is seen that when the object is located at location A, entirely outside of zone 1, the output signal of incoherent detector 1304 lies generally between upper and lower amplitude thresholds. When the object moves across location B, partially entering zone 1, the output signal of incoherent detector 1304 reaches a positive peak and exceeds the upper threshold. When the object moves across location C, entirely within zone 1, the output signal of incoherent detector 1304 lies generally between upper and lower amplitude thresholds. When the object moves across location D, partially leaving zone 1, the output signal of incoherent detector 1304 reaches a negative peak and exceeds the lower threshold. When the object is located at location E, the output signal of incoherent detector 1304 lies between the upper and lower amplitude thresholds.

The foregoing pattern is repeated for each crossing of a field of view.

It is appreciated that the motion detector circuitry, such as circuitry 114 (FIG. 1), is preferably operative to analyze the output of the incoherent detector 1304 and to determine the time separation between peaks, here designated T, and to correlate the time separation with the usual speed of travel of a human; to determine the amplitude of the peaks relative to the upper and lower thresholds and to correlate the amplitude with the amount of radiation normally emitted or reflected by a human; and to determine the time duration of the exceedance of the upper and lower thresholds by the peaks and to correlate this duration with the size and speed of the human.

The foregoing parameters are some of the parameters employed in accordance with the present invention for distinguishing sensed motion of humans from other sensed motion and other environmental phenomena.

Reference is now made to FIG. 14, which is a simplified illustration of a detector output produced by motion of an object through multiple spaced fields of view in accordance with another preferred embodiment of the invention. As seen in FIG. 14, an object 1400, such as a human, passes through a field of view defined by a lens 1402 and a detector array 1404, operative to detect receipt of radiation having a wavelength between 0.05 mm and 10 mm.

It is seen that the object 1400 moves into and out of the field of view seen by a sensing element 1406, here designated zone 1, into a region lying outside the fields of view and thence into the field of view seen by a sensing element 1408, here designated zone 2 and thence onward. The outputs of the sensing elements 1406, 1408 and 1410 are shown and labeled for correspondence with the presence of the object in the various fields of view.

More particularly, it is seen that when the object is located at location A, entirely outside of zone 1, the output signal of sensing element 1406 lies generally between upper and lower amplitude thresholds. When the object moves across location B, partially entering zone 1, the output signal of sensing element 1406 reaches a positive peak and exceeds the upper threshold. When the object moves across location C, entirely within zone 1, the output signal of sensing element 1406 lies generally between upper and lower amplitude thresholds. When the object moves across location D, partially leaving zone 1, the output signal of sensing element 1406 reaches a negative peak and exceeds the lower threshold. When the object is located at location E, the output signal of incoherent detector array 1404 lies between the upper and lower amplitude thresholds.

The foregoing pattern is repeated for each crossing of a field of view of a sensing element.

It is appreciated that the motion detector circuitry, such as circuitry 114 (FIG. 1), is preferably operative to analyze the output of the incoherent detector array 1404 and to determine the time separation between peaks, here designated T, and to correlate the time separation with the usual speed of travel of a human, to determine the amplitude of the peaks relative to the upper and lower thresholds and to correlate the amplitude with the amount of radiation normally emitted or reflected by a human; and to determine the time duration of the exceedance of the upper and lower thresholds by the peaks and to correlate this duration with the size and speed of the human.

The foregoing parameters are some of the parameters employed in accordance with the present invention for distinguishing sensed motion of humans from other sensed motion and other environmental phenomena.

Figure 15A:
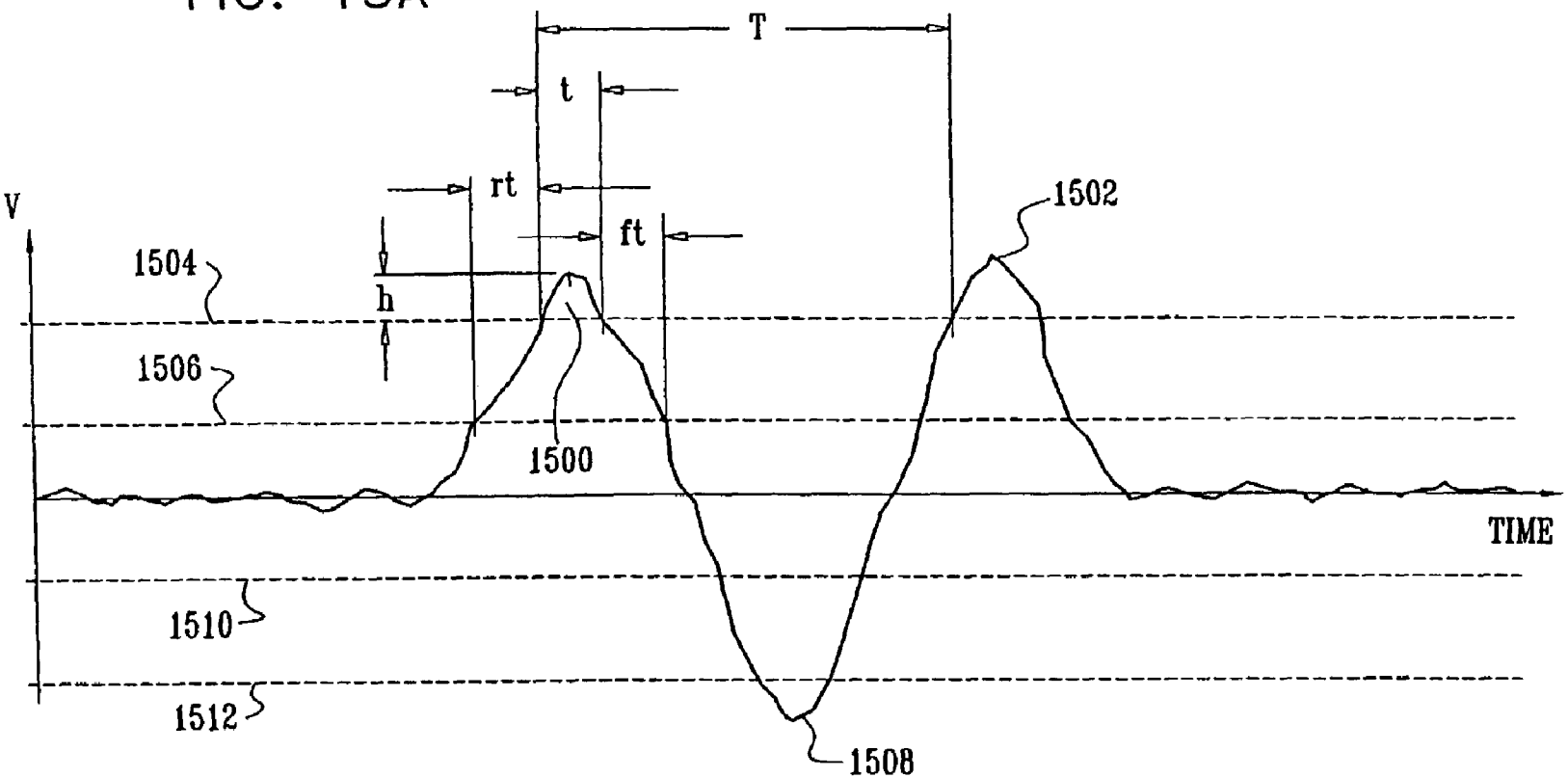
FIGS. 15A, 15B and 15C are simplified illustrations of three different detector outputs useful in understanding the operation of a preferred embodiment of the present invention.
Figure 15B:
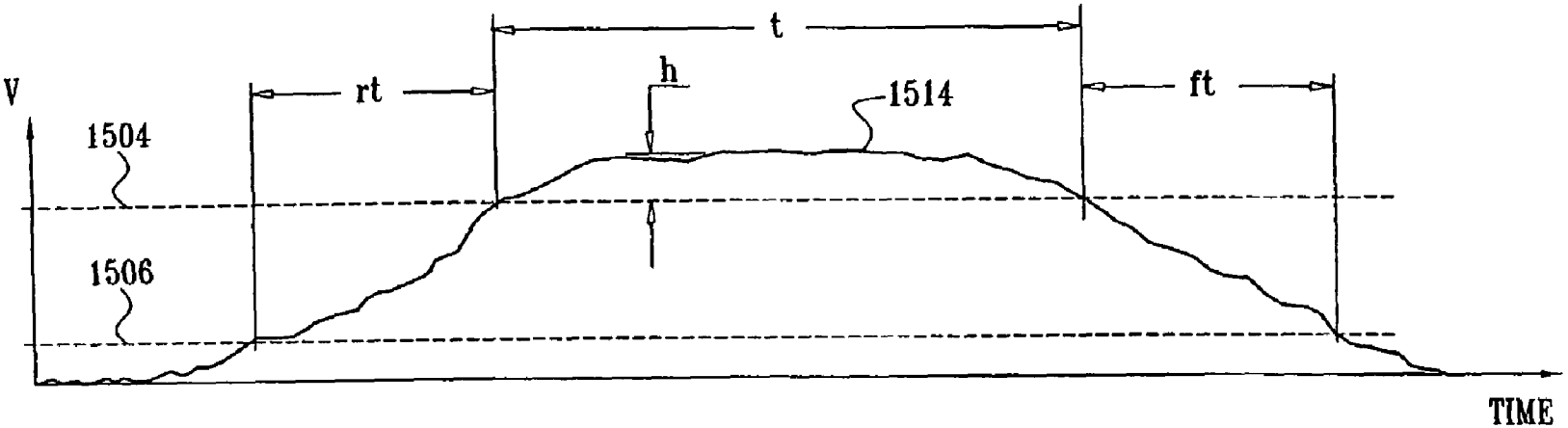
Figure 15C:
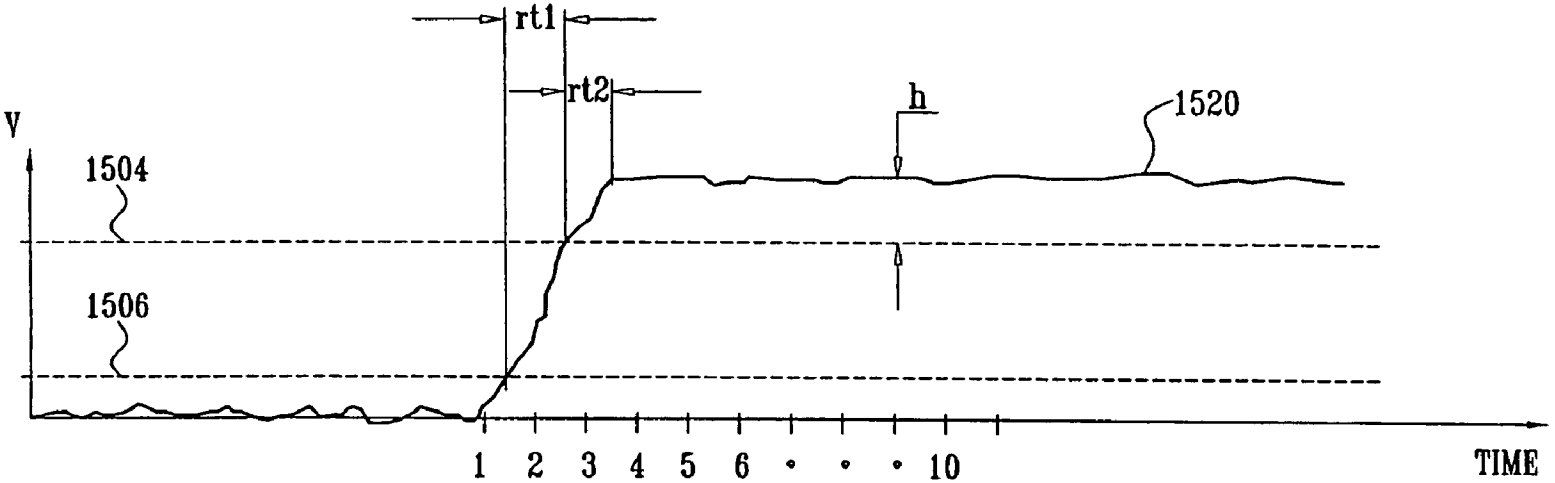

Reference is now made to FIGS. 15A, 15B and 15C, which are simplified illustrations of three different incoherent detector outputs useful in understanding the operation of a preferred embodiment of the invention. Turning to FIG. 15A, there is shown a waveform characteristic of the motion of a human between fields of view. Two positive peaks, here designated 1500 and 1502 are seen to exceed positive amplitude thresholds respectively designated by reference numerals 1504 and 1506. A negative peak, here designated by reference numeral 1508, is seen to exceed negative amplitude thresholds respectively designated by reference numerals 1510 and 1512. The peaks are characteristic of the radiation emitted or reflected by a human. The two positive peaks are spaced by a time duration T, characteristic of human walking motion.

FIG. 15A also shows details of the shape of a peak, here peak 1500. It is seen that the peak 1500 has a rise time between thresholds 1506 and 1504, designated rt, a width of t, where it crosses the threshold 1504, a maximum height above the threshold 1504 of h and a fall time between thresholds 1504 and 1506, designated ft. Parameters rt, t, h and ft are preferably employed by the motion detector to distinguish motion of a human from motion of other objects, such as pets.

Turning to FIG. 15B, there is shown a waveform not characteristic of the motion of a human between fields of view. A single relatively low hill, here designated 1514, is seen to exceed both first and second positive amplitude thresholds 1504 and 1506 and is characteristic of gradual environment changes or very slow movements of objects in a protected volume.

FIG. 15B also shows details of the shape of hill 1514. It is seen that the hill has a rise time between thresholds 1506 and 1504, designated rt, a width of t, where it crosses the threshold 1504, a maximum height above the threshold 1504 of h and a fall time between thresholds 1504 and 1506, designated ft. Parameters rt, t, h and ft are preferably employed by the motion detector to distinguish motion of a human from gradual environmental changes or very slow motion of objects within the protected volume.

Turning to FIG. 15C, there is shown a waveform characteristic of the motion of a human into a field of view, which motion is then terminated. A single relatively flat plateau, here designated 1520, is seen to exceed amplitude threshold 1504.

FIG. 15C also shows details of the shape of plateau 1520. It is seen that the plateau 1520 has a rise time, designated rt1, between amplitude thresholds 1506 and 1504 and a further rise time, designated rt2, above threshold 1504 and a height h above threshold 1504. Parameters rt1, rt2 and h are preferably employed by the motion detector to distinguish continuing motion of a human from stopped motion of a human within the protected volume.

Figure 16:
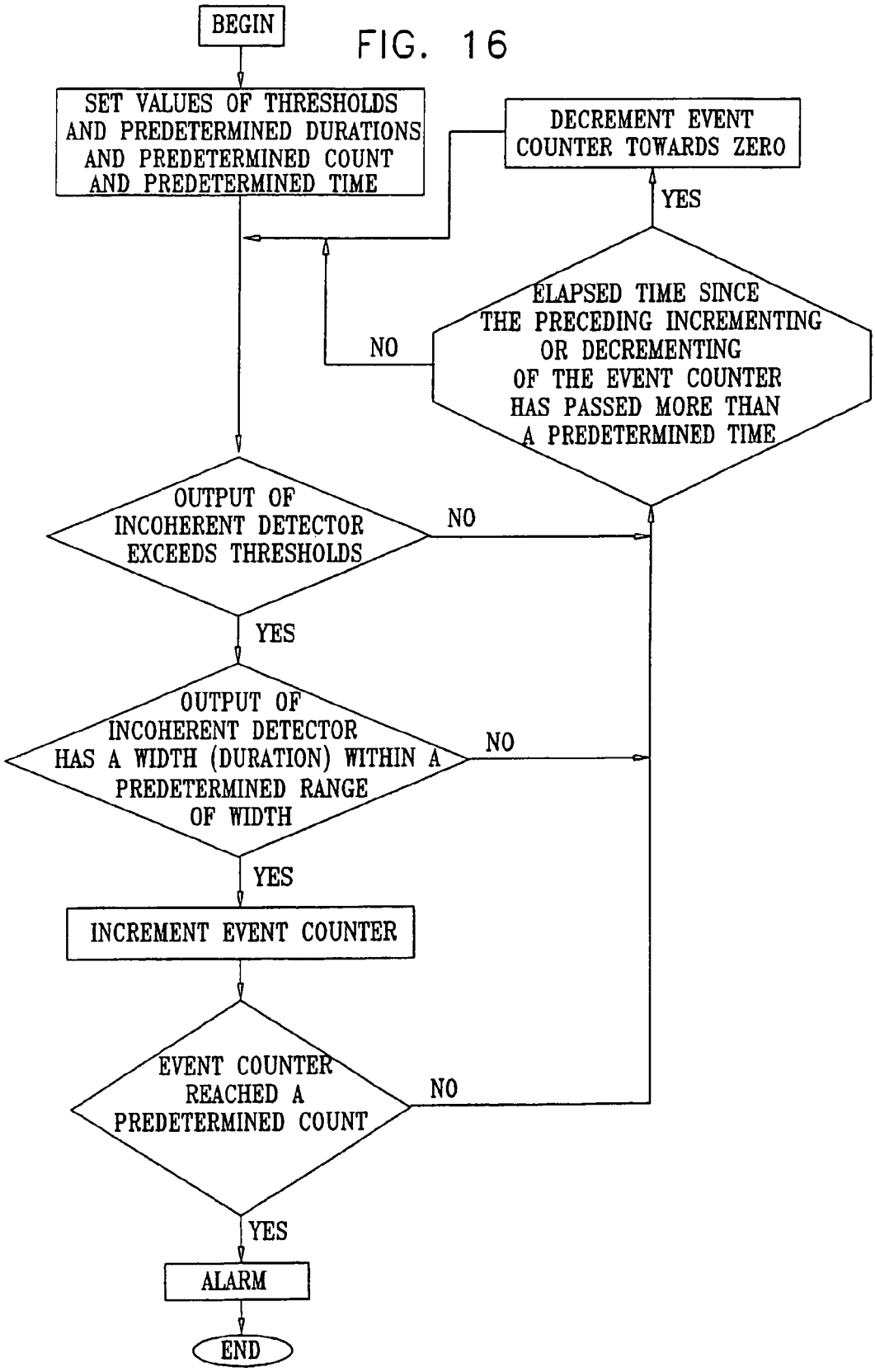
FIG. 16 is a simplified flowchart illustrating operation of a processor employed in the embodiment of FIGS. 5 & 8.

Reference is now made to FIG. 16, which is a simplified flowchart illustrating operation of a processor employed in the embodiment of FIGS. 5 & 8. As seen in FIG. 16, with additional reference to FIGS. 15A–15C, the thresholds 1504, 1506, 1510 and 1512 and other predetermined parameters are initially set.

An inquiry is made every unit time, typically once per 20 milliseconds, as to whether the output of the incoherent detector currently exceeds either of thresholds 1504 and 1512.

If the output of the incoherent detector does not currently exceed either of thresholds 1504 and 1512, a negative threshold exceedance output is provided.

If the output of the incoherent detector currently exceeds either of thresholds 1504 and 1512, an inquiry is then made as to whether the duration over which either of the thresholds 1504 and 1512 has been continuously exceeded, lies within a predetermined range of durations corresponding to the width t (FIG. 15A). Unless and until this occurs, a negative duration range output is provided.

If the output of the incoherent detector did cross either of thresholds 1504 and 1512 and has a width t which is within a predefined range of widths, an event counter is incremented. When the event counter reaches a predetermined count, an alarm output is provided. Until the event counter reaches the predetermined count, a negative event count exceedance output is provided.

Each time any one of the following outputs—negative threshold exceedance output, negative duration range output or negative event count exceedance output—is received, an inquiry is made as to whether at least a predetermined time, typically 5 times T (FIG. 15A), has elapsed since the preceding incrementing or decrementing of the event counter. If such a predetermined time has elapsed, the event counter is decremented towards zero.

Figures 17A, 17B:
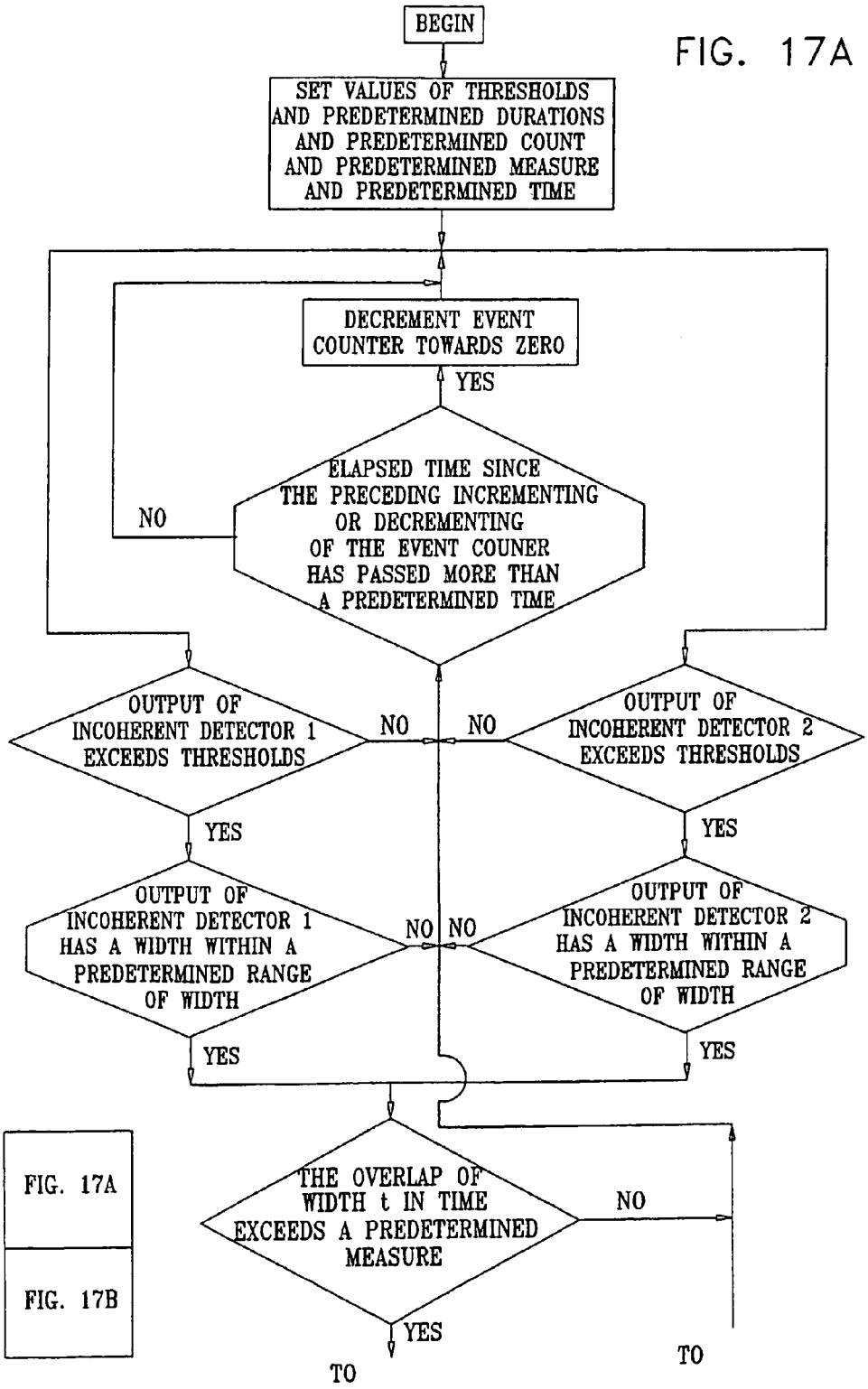
FIGS. 17A and 17B, taken together, form a simplified flowchart illustrating operation of a processor employed in the embodiment of FIGS. 6 & 7.
Figure 17B:
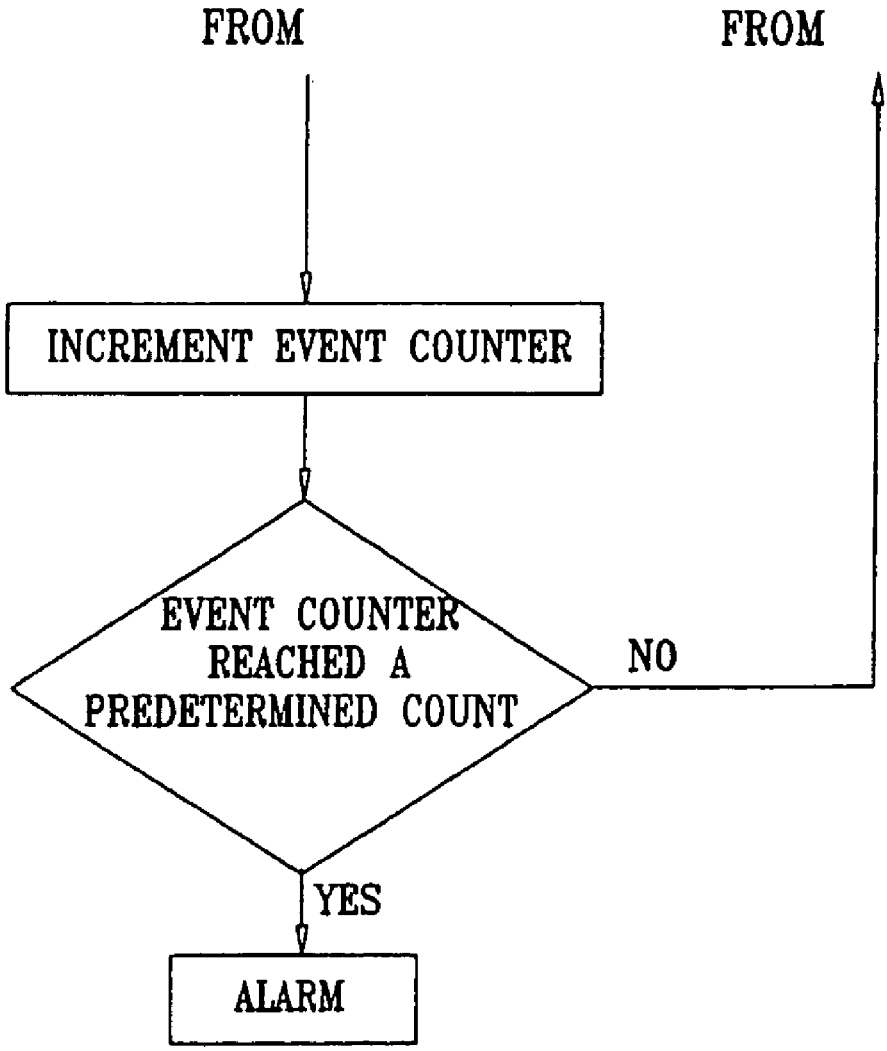

Reference is now made to FIGS. 17A and 17B, which, taken together, form a simplified flowchart illustrating operation of a processor employed in the embodiment of FIGS. 6 & 7. As seen in FIGS. 17A and 17B, with additional reference to FIGS. 15A–15C, the thresholds 1504, 1506, 1510 and 1512 and other predetermined parameters are initially set for each incoherent detector. It is appreciated that different incoherent detectors may have the same or different thresholds.

An inquiry is made every unit time, typically once per 20 milliseconds, as to whether the output of each of the two incoherent detectors 600 and 620 (FIG. 6) currently exceeds either of their respective thresholds 1504 and 1512.

If the output of either incoherent detector does not currently exceed either of its thresholds 1504 and 1512, a negative threshold exceedance output is provided by that incoherent detector.

If the output of either incoherent detector currently exceeds either of its thresholds 1504 and 1512, an inquiry is then made as to whether the duration, over which either of the thresholds 1504 and 1512 has been continuously exceeded, lies within a predetermined range of durations corresponding to the width t (FIG. 15A). It is appreciated that each of the incoherent detectors 600 and 620 may have the same or a different characteristic width t. Unless and until this occurs, a negative duration range output is provided.

If the outputs of both incoherent detectors did cross either one of their respective thresholds 1504 and 1512 and have widths t which are within their respective predefined range of widths, an inquiry is made as to the extent of the overlap of their widths t in time. It is appreciated that the predetermined range of widths for each incoherent detector may be the same or different.

If exceedance of at least a predetermined measure of overlap in time of the widths t of the outputs of the incoherent detectors 600 and 620 is found to exist, an event counter is incremented. When the event counter reaches a predetermined count, an alarm output is provided. Until the event counter reaches the predetermined count, a negative event count exceedance output is provided. Unless and until such measure of overlap exists, a negative overlap exceedance output is provided.

Each time any one of the following outputs—negative threshold exceedance output, negative duration range output, negative overlap exceedance output or negative event count exceedance output—is received, an inquiry is made as to whether at least a predetermined time, typically 5 times T (FIG. 15A), has elapsed since the preceding incrementing or decrementing of the event counter. If such a predetermined time has elapsed, the event counter is decremented towards zero.

Figures 18A, 18B:
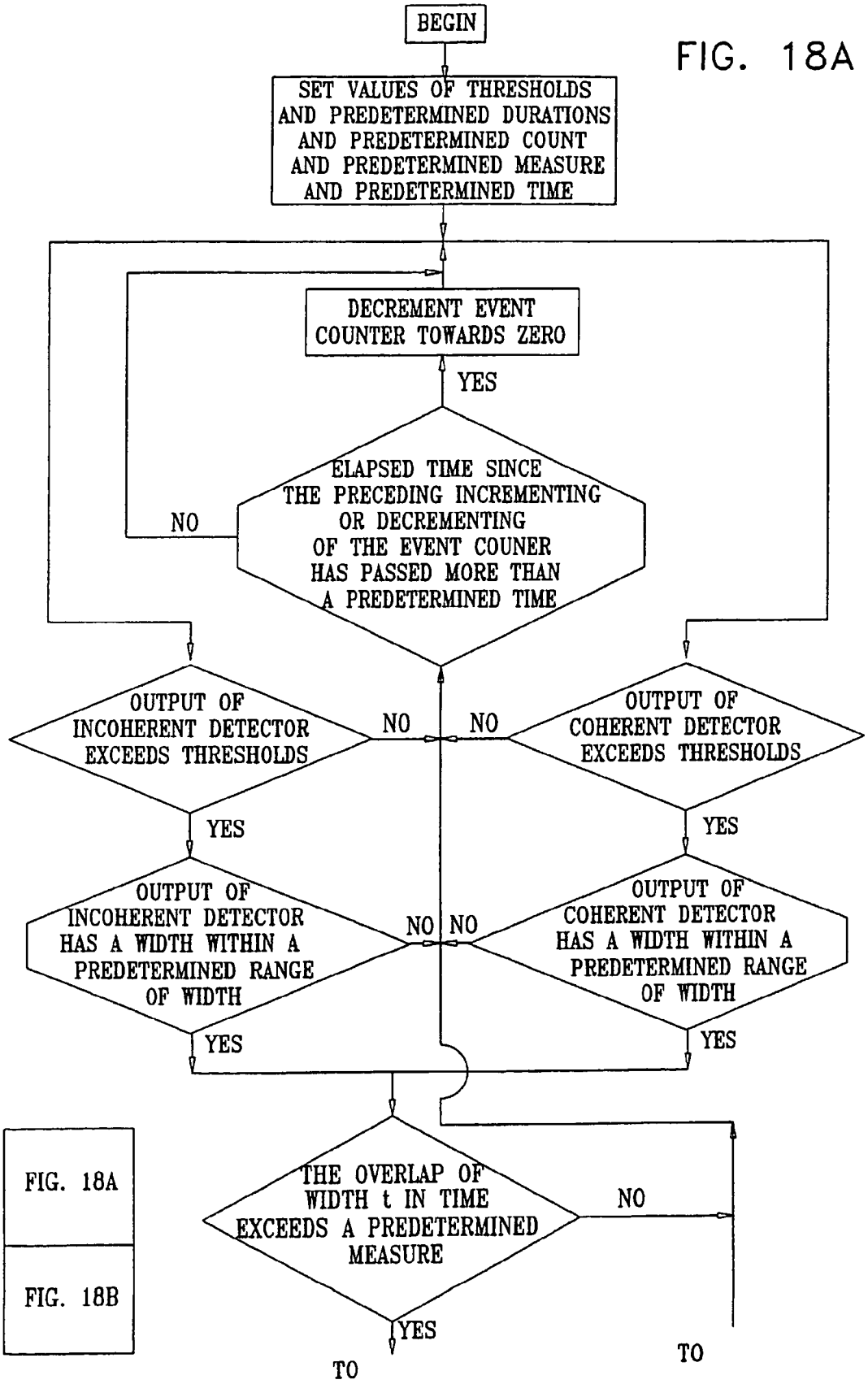
FIGS. 18A and 18B, taken together, form a simplified flowchart illustrating operation of a processor employed in the embodiment of FIG. 3B.
Figure 18B:
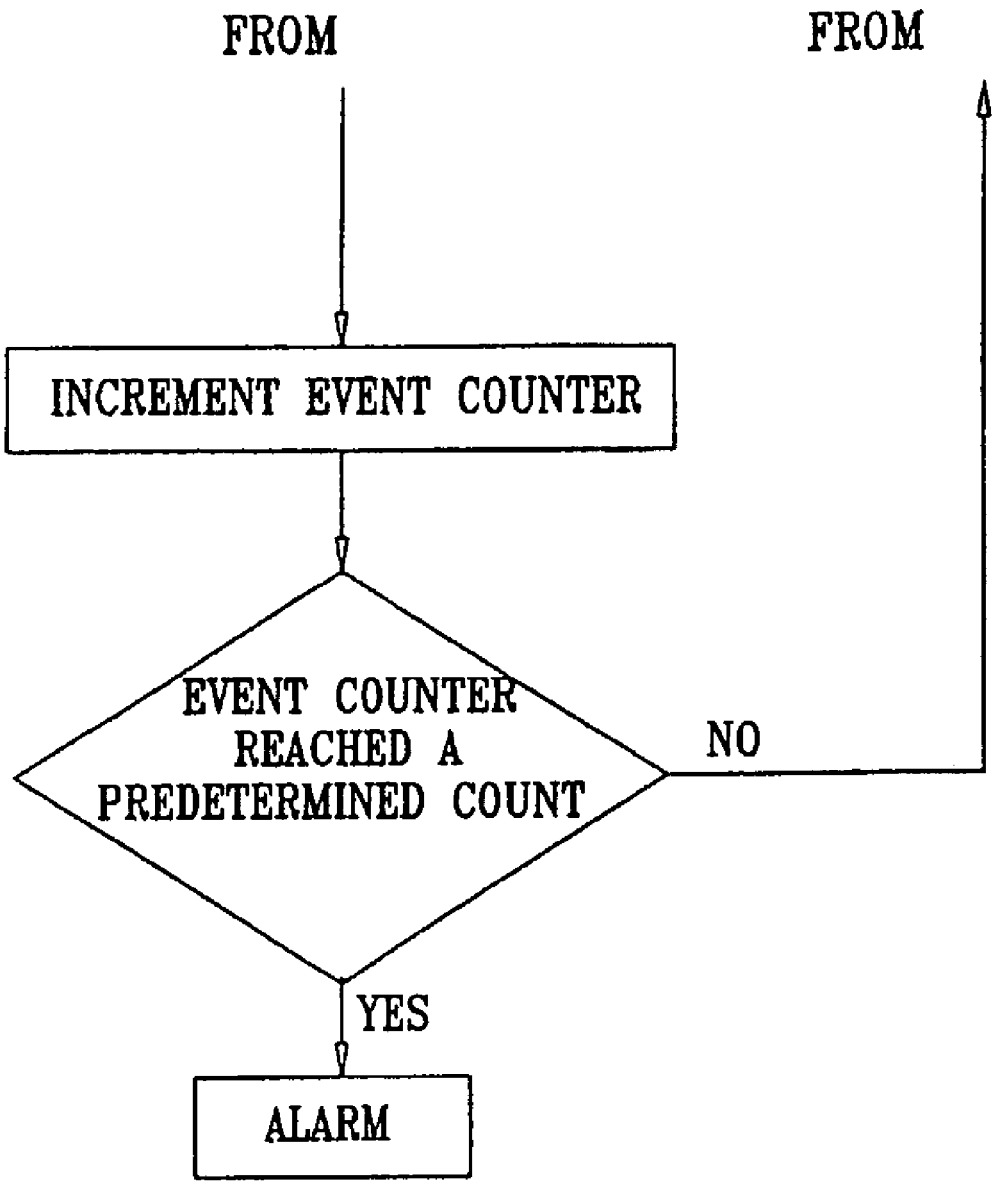

Reference is now made to FIGS. 18A and 18B, which, taken together, form a simplified flowchart illustrating operation of a processor employed in the embodiment of FIG. 3B. As seen in FIGS. 18A and 18B, with additional reference to FIGS. 15A–15C, the thresholds 1504, 1506, 1510 and 1512 and other predetermined parameters are initially set for incoherent detector 250 and for coherent detector 260 (FIG. 3B). It is appreciated that different detectors may have the same or different thresholds.

An inquiry is made every unit time, typically once per 20 milliseconds, as to whether the output of each of the two detectors 250 and 260 (FIG. 3B) currently exceeds either of their respective thresholds 1504 and 1512.

If the output of either detector does not currently exceed either of its thresholds 1504 and 1512, a negative threshold exceedance output is provided by that detector.

If the output of either detector currently exceeds either of its thresholds 1504 and 1512, an inquiry is then made as to whether the duration, over which either of the thresholds 1504 and 1512 has been continuously exceeded, lies within a predetermined range of durations corresponding to the width t (FIG. 15A). It is appreciated that each of the incoherent detectors 250 and 260 may have the same or a different characteristic width t. Unless and until this occurs, a negative duration range output is provided.

If the outputs of both detectors did cross either one of their respective thresholds 1504 and 1512 and have widths t which are within their respective predefined range of widths, an inquiry is made as to the extent of the overlap of their widths t in time. It is appreciated that the predetermined range of widths for each detector may be the same or different.

If exceedance of at least a predetermined measure of overlap in time of the widths t of the outputs of the detectors 250 and 260 is found to exist, an event counter is incremented. When the event counter reaches a predetermined count, an alarm output is provided. Until the event counter reaches the predetermined count, a negative event count exceedance output is provided. Unless and until such measure of overlap exists, a negative overlap exceedance output is provided.

Each time any one of the following outputs—negative threshold exceedance output, negative duration range output, negative overlap exceedance output or negative event count exceedance output—is received, an inquiry is made as to whether at least a predetermined time, typically 5 times T (FIG. 15A), has elapsed since the preceding incrementing or decrementing of the event counter. If such a predetermined time has elapsed, the event counter is decremented towards zero.

Figure 19:
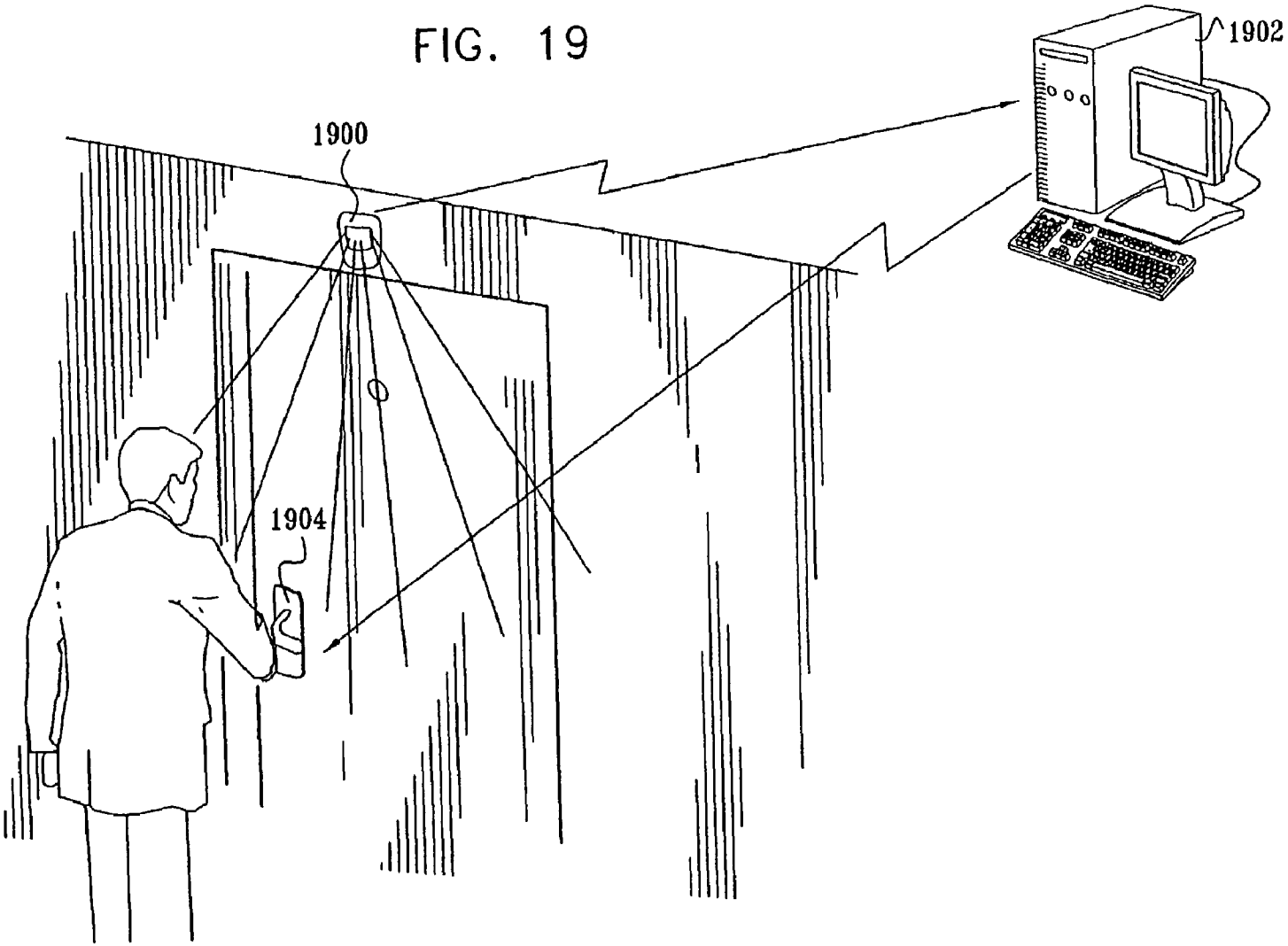
FIG. 19 is a simplified pictorial illustration of an access control system constructed and operative in accordance with a preferred embodiment of the present invention.

Reference is now made to FIG. 19, which is a simplified pictorial illustration of an access control system constructed and operative in accordance with a preferred embodiment of the present invention. As seen in FIG. 19, motion detection apparatus 1900 of the type shown and described hereinabove with reference to any of FIGS. 1–18 may be employed for access control.

The motion detection apparatus 1900 preferably comprises an incoherent detector operative to detect receipt of radiation having a wavelength between 0.05 mm and 10 mm. Access control circuitry 1902, typically embodied in a remote computer, receives an input from an output from the motion detector and provides an access control circuit output based at least partially thereon. The access control circuit output may be supplied to a door lock mechanism 1904 for selectably opening or locking a door or other access device.

Figure 20:
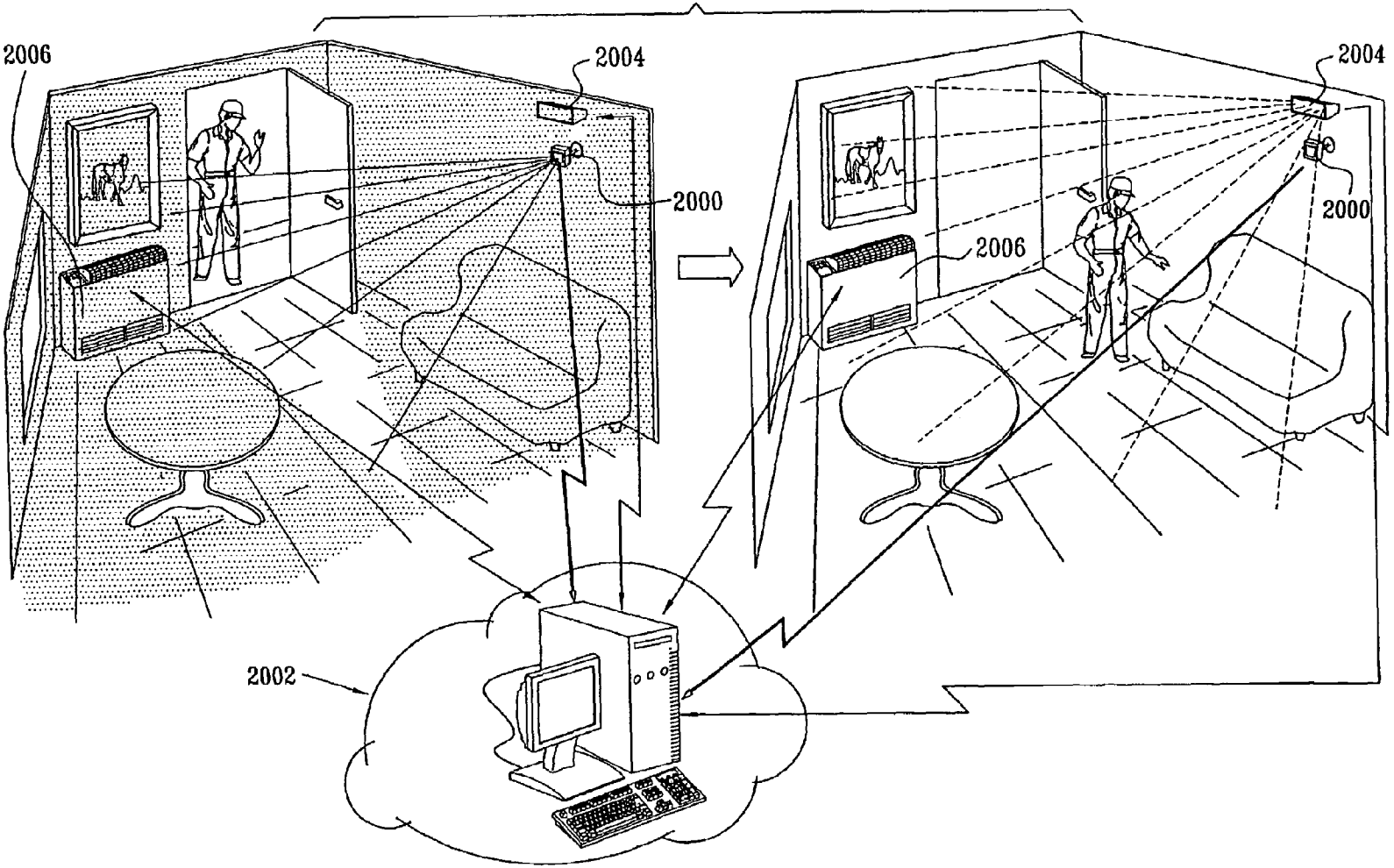
FIG. 20 is a simplified pictorial illustration of an energy management system constructed and operative in accordance with a preferred embodiment of the present invention.

Reference is now made to FIG. 20, which is a simplified pictorial illustration of an energy management system constructed and operative in accordance with a preferred embodiment of the present invention. As seen in FIG. 20, motion detection apparatus 2000 of the type shown and described hereinabove with reference to any of FIGS. 1–18 may be employed for energy management.

The motion detection apparatus 2000 preferably comprises an incoherent detector operative to detect receipt of radiation having a wavelength between 0.05 mm and 10 mm. Energy management circuitry 2002, typically embodied in a remote computer, receives an input from an output from the motion detector and provides an energy management circuit output based at least partially thereon. The access control circuit output may be supplied to lights 2004 and air conditioning apparatus 2006 for selectable operation thereof.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. Motion detection apparatus comprising:

a detector unit for detecting motion of an object and producing a plurality of detection output signals, including:

at least one first detector including at least one sensing element, operative to detect receipt of at least first radiation in the millimeter wave range having a wavelength between 0.05 mm and 10 mm; and at least first radiation input optics comprising an array of multiple optical segments for focusing millimeter wave radiation from first multiple spaced fields of view onto said at least one first detector, said at least one first detector generating a plurality of first output signals in response to receipt of said at least first radiation resulting from motion of said object between said first multiple spaced fields of view; and a processor receiving said plurality of detection output signals from said detector unit, said plurality of detection output signals including said plurality of first output signals, said processor being operative to process said plurality of detection output signals according to predefined criteria and to provide a motion detection output based on said criteria.

2. Motion detection apparatus according to claim 1 and wherein said processor provides said motion detection output indicating receipt of radiation from said object at least two different times having at least a predetermined time relationship therebetween.

3. Motion detection apparatus according to claim 1 and wherein said object comprises a human.

4. Motion detection apparatus according to claim 1 and wherein said processor is operative to sense differences between radiation received from humans and from other objects and to provide at least one motion detection output at least partially based on said differences.

5. Motion detection apparatus according to claim 1 and wherein said processor is operative to sense differences between radiation received from humans and from pets and to provide at least one motion detection output at least partially based on said differences.

6. Motion detection apparatus according to claim 5, and wherein said differences include at least one of differences in rise time of detection output signals of said radiation received from humans and from pets, differences in fall time of detection output signals of said radiation received from humans and from pets and differences in the duration of detection output signals.

7. Motion detection apparatus according to claim 1 and wherein said processor is operative to sense differences between radiation received from humans and from other objects by comparing the amplitude of received radiation.

8. Motion detection apparatus according to claim 1 and wherein said processor is operative to sense differences between radiation received from humans and from the objects by comparing characteristics of received radiation.

9. Motion detection apparatus according to claim 1 and wherein said processor is operative to sense differences between radiation received from humans and from other objects by comparing patterns of received radiation.

10. Motion detection apparatus according to claim 1 and wherein said processor is operative .to sense differences between radiation received from humans and from other objects by comparing shapes of received radiation.

11. Motion detection apparatus according to claim 1 and wherein said processor is operative to sense differences between radiation received from humans and from other objects by comparing the amplitude of received radiation at multiple wavelengths over time.

12. Motion detection apparatus according to claim 1 and wherein said at least first radiation input optics is disposed upstream of said at least one first detector.

13. Motion detection apparatus according to claim 1 and wherein said at least first radiation input optics comprises at least one lens.

14. Motion detection apparatus according to claim 1 and wherein said at least first radiation input optics comprises at least one reflector.

15. Motion detection apparatus according to claim 1 and wherein said at least first radiation input optics comprises a plurality of optical elements, operative at a different wavelength ranges.

16. Motion detection apparatus according to claim 1 and also comprising an illuminator providing radiation having a wavelength between 0.05 mm and 10 mm into a region covered by said first multiple spaced fields of view.

17. Motion detection apparatus according to claim 1 and also comprising at least one second detector which is operative to detect receipt of at least second radiation having a wavelength range generally different from the range of said at least first radiation.

18. Motion detection apparatus according to claim 17, and wherein said at least one second detector generates a plurality of second output signals in response to receipt of said at least second radiation resulting from motion of said object between second multiple spaced fields of view.

19. Motion detection apparatus according to claim 18, and wherein said second multiple spaced fields of view are defined by at least second radiation input optics for focusing radiation in a wavelength range of said at least second radiation from said second multiple spaced fields of view onto said at least one second detector.

20. Motion detection apparatus according to claim 19, and wherein said at least second radiation input optics comprises a lens.

21. Motion detection apparatus according to claim 19, and wherein said at least first radiation input optics and said at least second radiation input optics are common radiation input optics operative to focus millimeter wave radiation in a wavelength range of said at least first radiation and of said at least second radiation.

22. Motion detection apparatus according to claim 21, and wherein said common radiation input optics comprises a lens made of at least one of Polyethylene and TEFLON® material.

23. Motion detection apparatus according to claim 19, and wherein said at least first radiation input optics and said at least second radiation input optics comprise different radiation input optics.

24. Motion detection apparatus according to claim 18, and wherein each of said at least one first detector and said at least one second detector also comprises respective first and second filter elements operative in respective wavelength ranges of said at least first radiation and of said at least second radiation.

25. Motion detection apparatus according to claim 17, and wherein said at least one second detector comprises an incoherent detector.

26. Motion detection apparatus according to claim 17, and wherein said at least one second detector comprises a passive infrared detector.

27. Motion detection apparatus according to claim 17, and wherein said at least second radiation has a wavelength lying within the range of between 0.1 mm and 0.5 mm.

28. Motion detection apparatus according to claim 17, and wherein said .at least second radiation has a wavelength lying within the range of between 0.01 mm and 0.1 mm.

29. Motion detection apparatus according to claim 17, and wherein said at least second radiation has a wavelength lying within the range of between 0.001 mm and 0.015 mm.

30. Motion detection apparatus according to claim 17, and wherein said at least second radiation has a wavelength lying within the range of between 0.05 mm and 10 mm.

31. Motion detection apparatus according to claim 17, and wherein said at least one second detector comprises an active detector.

32. Motion detection apparatus according to claim 31, and wherein said active detector comprises a microwave detector operative to transmit and detect radiation having a frequency in the range of 0.5–30 Ghz.

33. Motion detection apparatus according to claim 31, and wherein said active detector comprises a millimeter wave detector operative to transmit and detect millimeter wave radiation.

34. Motion detection apparatus according to claim 31, and wherein said active detector comprises an optical detector operative to transmit and detect optical radiation.

35. Motion detection apparatus according to claim 17, and wherein said criteria include receiving at least first detection output signal from said at least one first detector operative in a first radiation range and at least second detection output signal from said at least one second detector operative in a second radiation range, said at least first detection output signal and said at least second detection output signal having at least a predetermined time relationship therebetween.

36. Motion detection apparatus according to claim 1, and wherein said at least one first detector comprises at least one incoherent detector array.

37. Motion detection apparatus according to claim 36, and wherein said at least one incoherent detector array is associated with at least one filter.

38. Motion detection apparatus according to claim 36, and wherein said at least one incoherent detector array views a human target through a common focusing optical element.

39. Motion detection apparatus according to claim 36, and wherein output signals of said at least one incoherent detector array are supplied via a signal multiplexer to a microprocessor for further processing.

40. Motion detection apparatus according to claim 39, and wherein said further processing includes analog to digital conversion of said output signals of said at least one incoherent detector array.

41. Motion detection apparatus according to claim 1, and wherein said millimeter wave radiation is emitted from said object.

42. Motion detection apparatus according to claim 1, and wherein said millimeter wave radiation is reflected by said object.

43. Motion detection apparatus according to claim 42, and wherein said reflected radiation is at least partially provided by an illuminator.

44. Motion detection apparatus according to claim 1, and wherein said plurality of first output signals results from differences between millimeter wave radiation emitted from said object and millimeter wave radiation emitted from at least a second object in said first multiple spaced fields of view.

45. Motion detection apparatus according to claim 1, and wherein said criteria include receiving at least two detection output signals at at least two different times having at least a predetermined time relationship therebetween.

46. Motion detection apparatus according to claim 45, and wherein said at least two output detection signals at at least two different times are produced by motion of said object through said first multiple spaced fields of view.

47. Motion detection apparatus according to claim 45, and wherein said time relationship comprises at least a partial time overlap.

48. Motion detection apparatus according to claim 1, and wherein said criteria comprise criteria for activating an alarm.

49. Motion detection apparatus according to claim 1, and wherein said criteria comprise criteria for controlling access.

50. Motion detection apparatus according to claim 1, and wherein said criteria comprise criteria for opening a door.

51. Motion detection apparatus according to claim 1, and wherein said criteria comprise criteria for activating light.

52. Motion detection apparatus according to ,claim 1, and wherein said criteria comprise criteria for switching on at least one HVAC system.

53. Motion detection apparatus according to claim 1, and wherein said criteria comprise criteria for switching off at least one HVAC system.

54. A method for motion detection comprising:

detecting motion of an object and producing a plurality of detection output signals including:

detecting receipt of at least first radiation having a wavelength between 0.05 mm and 10 mm utilizing at least a first detector, including at least one sensing element; and focusing millimeter wave radiation from first multiple spaced fields of view onto said at least one first detector, utilizing at least first radiation input optics comprising an array of multiple optical segments, generating a plurality of first output signals utilizing said at least one first detector, in response to receipt of said at least first radiation resulting from said object moving between said first multiple spaced fields of view; and receiving said plurality of detection output signals from said at least one first detector utilizing a processor, said plurality of detection output signals including said plurality of first output signals;

processing said plurality of detection output signals according to predefined criteria; and providing a motion detection output based on said criteria.

55. A method for motion detection according to claim 54 and wherein said generating a plurality of first output signals comprises generating a motion detection output at at least two different times having at least a predetermined time relationship therebetween.

56. A method for motion detection according to claim 54 and wherein said detecting motion of an object comprises detecting motion of a human.

57. A method for motion detection according to claim 54 and wherein said detecting receipt comprises:

sensing differences between radiation received from humans and from other objects; and providing at least one motion detection output at least partially based on said differences.

58. A method for motion detection according to claim 54 and wherein said detecting receipt comprises:

sensing differences between radiation received from humans and from pets; and providing at least one motion detection output at least partially based on said differences.

59. A method for motion detection according to claim 54 and wherein said detecting receipt comprises sensing differences between radiation received from humans and from other objects by comparing the amplitude of received radiation.

60. A method for motion detection according to claim 54 and wherein said detecting receipt comprises sensing differences between radiation received from humans and from other objects by comparing characteristics of received radiation.

61. A method for motion detection according to claim 54 and wherein said detecting receipt comprises sensing differences between radiation received from humans and from other objects by comparing patterns of received radiation.

62. A method for motion detection according to claim 54 and wherein said detecting receipt comprises sensing differences between radiation received from humans and from other objects by comparing shapes of received radiation.

63. A method for motion detection according to claim 54 and wherein said detecting receipt comprises sensing differences between radiation received from humans and from other objects by comparing the amplitude of received radiation at multiple wavelengths over time.

64. A method for motion detection according to claim 54 and wherein said utilizing at least one first detector comprises utilizing said at least first radiation input optics which are disposed upstream of said at least one first detector.

65. A method for motion detection according to claim 54 and wherein said at least one first radiation input optics comprises at least one lens.

66. A method for motion detection according to claim 54 and wherein said at least one first radiation input optics comprises at least one reflector.

67. A method for motion detection according to claim 54 and wherein said at least one first radiation input optics comprises a plurality of optical elements, each operative at a different wavelength range.

68. A method for motion detection according to claim 54 and also comprising providing radiation, having a wavelength between 0.05 mm and 10 mm, utilizing an illuminator, into a region which is viewed by said at least one first detector.

69. A method for motion detection according to claim 54 and also including detecting receipt of at least second radiation having a wavelength range generally different from the range of said at least first radiation utilizing an at least one second detector.

70. A method for motion detection according to claim 69, and also comprising generating a plurality of second output signals utilizing said at least one second detector, in response to receipt of said at least second radiation resulting from motion of said object between second multiple spaced fields of view.

71. A method for motion detection according to claim 70, and also including defining said second multiple spaced fields of view by at least second radiation input optics for focusing radiation in a wavelength range of said at least second radiation from said second multiple spaced fields of view onto said at least one second detector.

72. A method for motion detection according to claim 71, and wherein said at least second radiation input optics comprises a lens.

73. A method for motion detection according to claim 71, and wherein said at least first radiation input optics and said at least second radiation input optics are common radiation input optics operative to focus millimeter wave radiation in a wavelength range of said at least first radiation and of said at least second radiation.

74. A method for motion detection according to claim 71, and wherein said at least first radiation input optics and said at least second radiation input optics comprise different radiation input optics.

75. A method for motion detection according to claim 69, wherein said at least one first detector and said at least one second detector comprise detectors of generally the same type.

76. A method for motion detection according to claim 69, and wherein each of said at least one first detector and said at least one second detector also comprises respective first and second filter elements operative in respective wavelength ranges of said at least first radiation and of said at least second radiation.

77. A method for motion detection according to claim 69, and wherein said at least one second detector comprises a passive infrared detector.

78. A method for motion detection according to claim 69, and wherein said at least second radiation has a wavelength lying within the range of between 0.01 mm and 0.1 mm.

79. A method for motion detection according to claim 69, and wherein said at least second radiation has a wavelength lying within the range of between 0.001 mm and 0.015 mm.

80. A method for motion detection according to claim 69, and wherein said at least second radiation has a wavelength lying within the range of between 0.05 mm and 10 mm.

81. A method for motion detection according to claim 54, and wherein said at least one first detector comprises at least one incoherent detector array.

82. A method for motion detection according to claim 81, and wherein said at least one incoherent detector array is associated with at least one filter.

83. A method for motion detection according to claim 81, and wherein said at least one incoherent detector array views a human target through a common focusing optical element.

84. A method for motion detection according to claim 81, and also comprising supplying output signals of said at least one incoherent detector array via a signal multiplexer to a microprocessor for further processing.

85. A method for motion detection according to claim 84, and wherein said further processing includes analog to digital conversion of said output signals of said at least one incoherent detector array.

86. A method for motion detection according to claim 69, and wherein said at least one second detector comprises an active detector.

87. A method for motion detection according to claim 86, and wherein said active detector comprises a microwave detector operative to transmit and detect radiation having a frequency in the range of 0.5–30 Ghz.

88. A method for motion detection according to claim 86, and wherein said active detector comprises a millimeter wave detector operative to transmit and detect millimeter wave radiation.

89. A method for motion detection according to claim 86, and wherein said active detector comprises an optical detector operative to transmit and detect optical radiation.

90. A method for motion detection according to claim 69, and wherein said criteria include receiving at least first detection output signal from said at least one first detector operative in a first radiation range and at least second detection output signal from said at least one second detector operative in a second radiation range, said at least first detection output signal and said at least second detection output signal having at least a predetermined time relationship therebetween.

91. A method for motion detection according to claim 90, and wherein said time relationship comprises at least a partial time overlap.

92. A method for motion detection according to claim 69, wherein said at least second radiation has a wavelength lying within the range of between 0.1 mm and 0.5 mm.

93. A method for motion detection according to claim 54, and wherein said millimeter wave radiation is emitted from said object.

94. A method for motion detection according to claim 54, and wherein said millimeter wave radiation is reflected by said object.

95. A method for motion detection according to claim 54, and wherein said plurality of first output signals results from differences between millimeter wave radiation emitted from said object and millimeter wave radiation emitted from at least a second object in said first multiple spaced fields of view.

96. A method for motion detection according to claim 54, and wherein said criteria include receiving at least two detection output signals at at least two different times having at least a predetermined time relationship therebetween.

97. A method for motion detection according to claim 96, and also comprising producing said at least two detection output signals at at least two different times by motion of said object through said first multiple spaced fields of view.

98. A method for motion detection according to claim 54, and wherein said criteria comprise criteria for activating an alarm.

99. A method for motion detection according to claim 54, and wherein said criteria comprise criteria for controlling access.

100. A method for motion detection according to claim 54, and wherein said criteria comprise criteria for opening a door.

101. A method for motion detection according to claim 54, and wherein said criteria comprise criteria for activating light.

102. A method for motion detection according to claim 54, and wherein said criteria comprise criteria for switching on at least one HVAC system.

103. A method for motion detection according to claim 54, and wherein said criteria comprise criteria for switching off at least one HVAC system.

104. A method for motion detection according to claim 54, and also comprising providing radiation in the millimeter wave range having a wavelength lying within the range of 0.05 mm and 10 mm into a region covered by said first multiple spaced fields of view, utilizing an illuminator.

* * * * *